United States Patent [19]

O'Connor et al.

[11] 4,060,971

[45] Dec. 6, 1977

[54] SOLID STATE WATCH WITH INERTIAL SWITCH

[75] Inventors: Arthur H. O'Connor; Robert E. McCullough, both of Lancaster, Pa.

[73] Assignee: Time Computer, Inc., Lancaster, Pa.

[21] Appl. No.: 504,734

[22] Filed: Sept. 10, 1974

[51] Int. Cl.[2] ..... G04B 19/24; G04C 3/00

[52] U.S. Cl. ..... 58/4 A; 58/23 R; 58/50 R; 361/414

[58] Field of Search ..... 58/33, 4 A, 50 R, 55, 58/85.5, 152 R, 23 R, 23 A, ; 339/17 R, 17 A, 17 CF, 17 LM, 17 M, 17 N; 361/414

[56] References Cited

U.S. PATENT DOCUMENTS

| | | | |
|---|---|---|---|
| 3,148,310 | 9/1964 | Feldman | 339/17 M X |
| 3,672,155 | 6/1972 | Bergey et al. | 58/50 R |
| 3,739,469 | 6/1973 | Dougherty | 361/414 |
| 3,742,699 | 7/1973 | Bergey | 58/50 R |
| 3,757,510 | 9/1973 | Dill | 58/50 R |
| 3,759,031 | 9/1973 | McCullough et al. | 58/55 |
| 3,765,163 | 10/1973 | Levine et al. | 58/50 R |
| 3,803,827 | 4/1974 | Roberts | 58/4 A |
| 3,863,436 | 2/1975 | Schwarzchild et al. | 58/50 R |
| 3,914,932 | 10/1975 | Teraishi et al. | 58/50 R |

*Primary Examiner*—E. S. Jackmon
*Attorney, Agent, or Firm*—LeBlanc & Shur

[57] ABSTRACT

Disclosed is a solid state wristwatch of relatively small size useful as a small man's watch or even a ladies' watch. It incorporates an arm responsive inertial switch for energizing a light emitting diode display. The display forms part of a timing module and is mounted on one side of a laminar ceramic substrate. Mounted on the other side of the substrate is a combination timepiece and calendar circuit chip. Printed circuits are formed on non-contacting surfaces of the substrate laminations and interconnected by conductive pins. The entire timing module is staked to a plastic frame which also carries the watch batteries, quartz crystal, trimmer capacitor, switches, or other watch components.

19 Claims, 36 Drawing Figures

SEE FIG. 7b

FF
170
168
8HZ
614
252
580
596
FF1
COUNTER
R
594
604
600
602
598
FF2
606
590
592
71
582
584
586
588
608
603
+VDD
2HZ
262
17
254
258
256
259
8HZ
FF14
FF13
FF12
FF1
160
290
288
286
OSCILLATOR
20
22
21
23 a
b
c
d
e
f
g
h
i

I
T.G.
298
280
278
282
284
SEE FIG. 7e
G
384
382
380
378
T.G.
398
T.G.
296
T.G.
294
T.G.
376
432
434
430
436
494
494
374
+
SEE FIG. 7h
SEE FIG. 7g
SEE FIG. 7f

FIG. 9
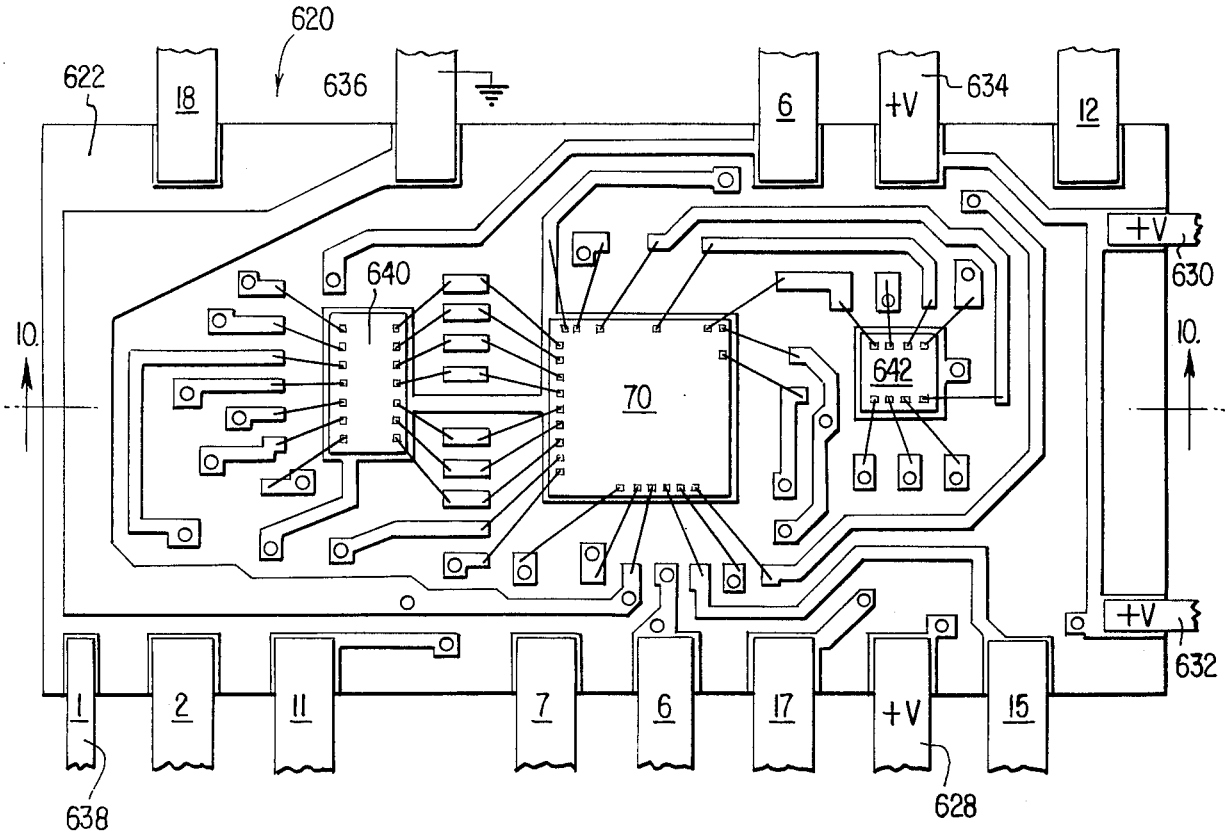
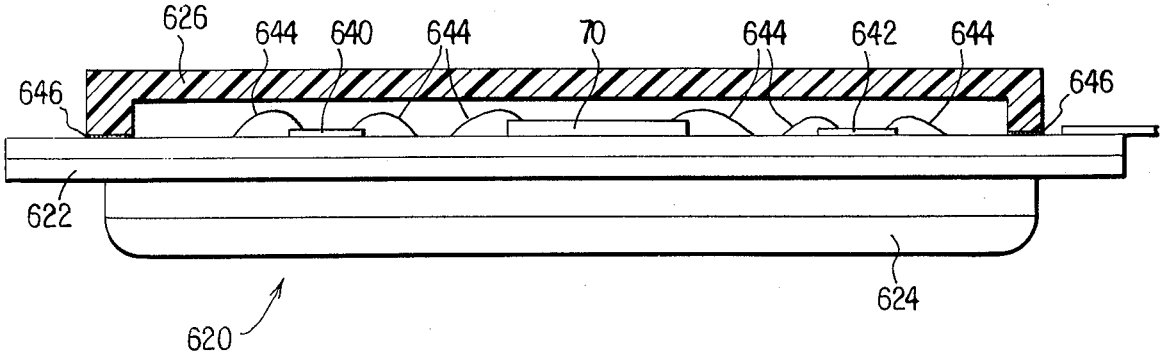
FIG. 10

FIG. 24
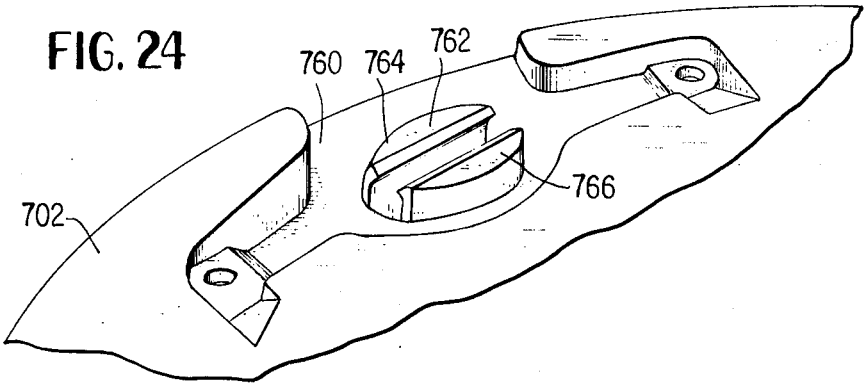
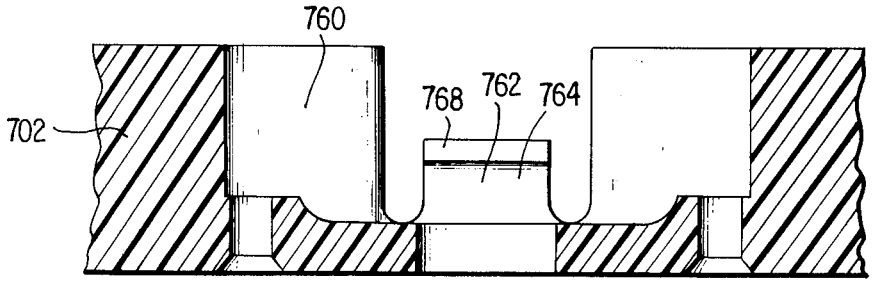
FIG. 25
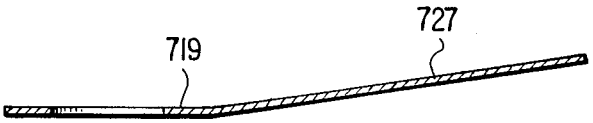
FIG. 15a
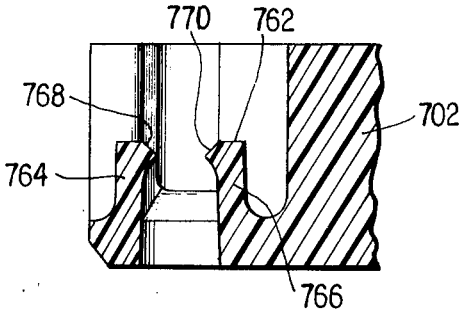
FIG. 26
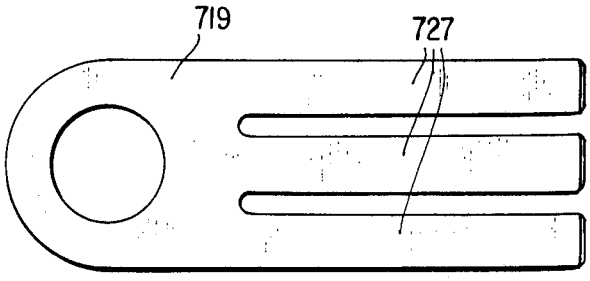
FIG. 15b FIG. 19
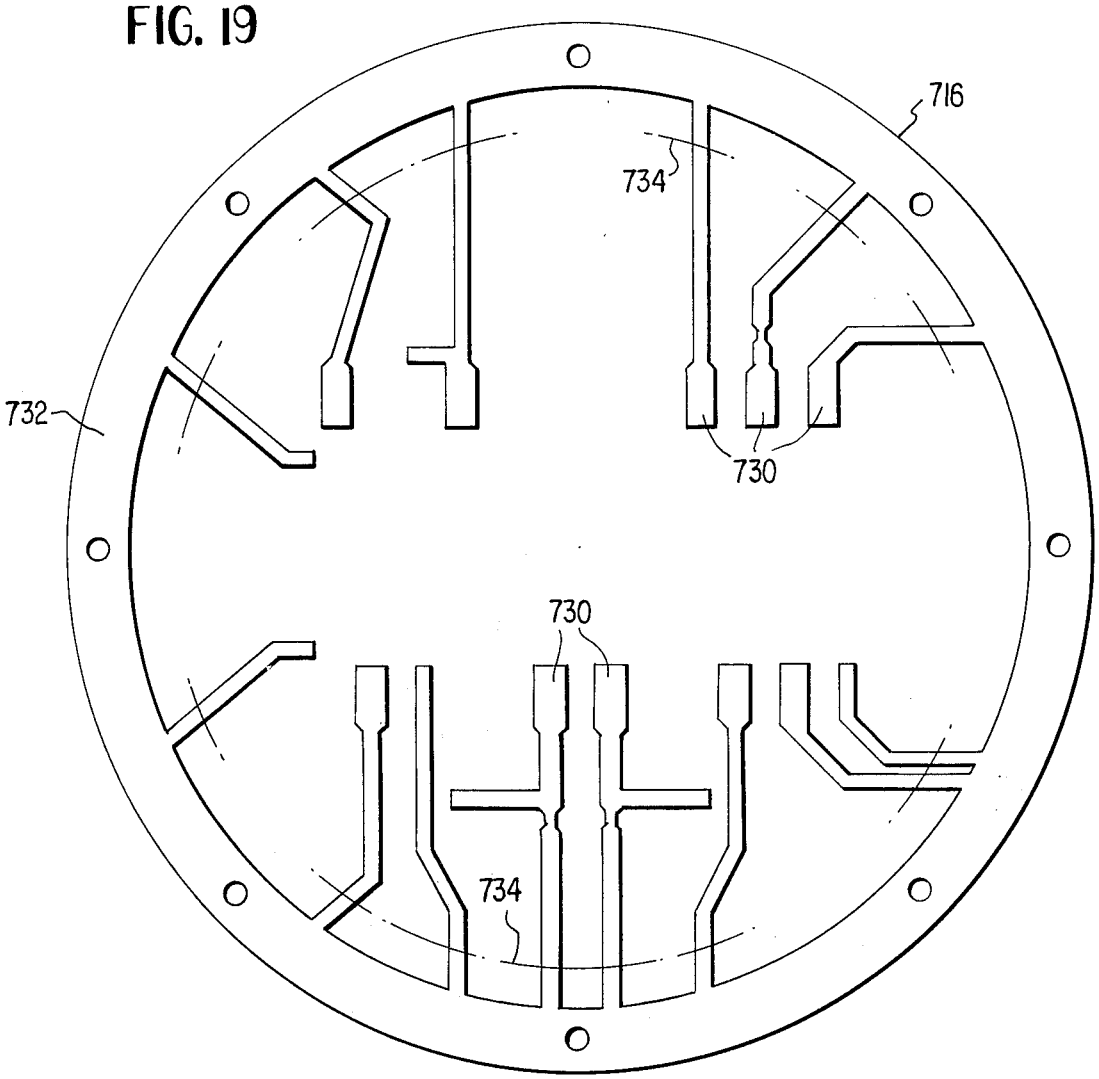
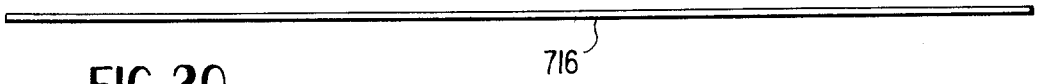
FIG. 20
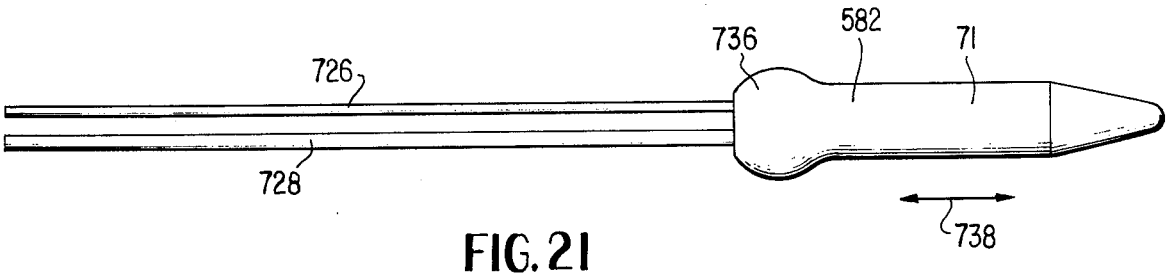
FIG. 21

SOLID STATE WATCH WITH INERTIAL SWITCH

This invention is directed to improvements to the watch construction disclosed and claimed in U.S. application Ser. No. 328,639 filed Feb. 1, 1973 in the name of Dennis A. Roberts and incorporates an inertial switch of the type disclosed and claimed in U.S. application Ser. No. 354,192 filed Apr. 25, 1973 in the name of John M. Bergey, both of the above-identified applications being assigned in common with the present case.

This invention relates to a solid state timepiece and more particularly to an electronic wristwatch which employs substantially no moving parts. In the present invention, a frequency standard in the form of a crystal oscillator acts through solid state electronic circuit dividers and drivers to power in timed sequence the light emitting diodes of an electro-optical display. In particular, the present invention is directed to a wristwatch of simplified and less expensive construction and especially one that can be constructed of smaller size so that it may be incorporated in smaller men's and even ladies' watches.

Battery powered wristwatches and other small portable timekeeping devices of various types are well known and are commercially available. The first commercially successful battery powered wristwatch was of the electromechanical type shown and described in U.S. Pat. No. Re. 26,187, reissued Apr. 4, 1967 to John A. VanHorn et al for Electronic Watch.

In recent years, considerable effort has been directed toward the development of a wristwatch which does not employ an electromechanical oscillator as the master time reference. For example, in assignee's U.S. Pat. No. 3,560,998, issued Feb. 2, 1971, there is shown a wristwatch in which the master time reference is formed by a high frequency oscillator connected to the watch display through a divider formed of low power complementary MOS transistor circuits. In assignee's U.S. Pat. No. 3,567,099, issued Apr. 27, 1971, there is disclosed a watch construction in which the optical display is described as a plurality of light emitting diodes which are intermittently energized to assure minimum power consumption and an increasingly long life for the watch battery. Improved watch constructions of this general type incorporating solid state circuits and integrated circuit techniques are disclosed in assignee's U.S. Pat. Nos. 3,672,155, 3,760,584, 3,742,699, 3,759,031, and others.

The present invention is directed to an improved wristwatch construction of the same general type as disclosed in the above mentioned applications and patents but one which is of more simplified and less expensive construction. In particular, the wristwatch construction of the present invention makes possible a smaller wristwatch, i.e., one that is smaller both in diameter (or length and width if non-circular) and thickness. As a result, the watch construction of the present invention is particularly adapted for incorporation into the smaller sized men's wristwatch cases and in some instances may be sufficiently small so as to form a lady's wristwatch. The reduction in size is effected in the construction of the present invention while, at the same time, maintaining the reliability, ease of assembly, ease of maintenance, ease of manufacture, increased shock and impact resistance, and excellent accuracy of assignee's previous constructions.

In the present invention, a frequency standard in the form of a crystal controlled oscillator is coupled through an integrated circuit frequency divider and display actuator to an electro-optical visual display in the form of a plurality of light-emitting diodes. Mounted in the wristwatch case is a rugged impact resistance one-piece frame which houses the entire wristwatch assembly including the wristwatch battery. Secured in the rear side of the module frame are a pair of battery cells and an oscillator trimmer capacitor so that ready access may be had to these cells and the trimmer by removal of the watch case back. Also mounted on the frame is a combination timekeeping and calendar unit which comprises an electro-optical LED display, a single large scale integrated CMOS circuit chip, related circuit components and the innerconnecting electrical circuitry. Also mounted on the frame is an oscillator crystal, a pair of demand switches, a pair of setting switches and an inertial switch. The two demand switches are used to alternatively energize the light emitting diode display, to indicate either time or calendar information. The setting switches are for setting the time and calendar displays while the inertial switch makes it possible to display time by a predetermined movement of the wearer's arm independent of the time demand switch.

The watch display is visible through a red colored filter and is formed from a plurality of light emitting diodes which are preferably arranged in a seven bar segment array. The light emitting diodes are energized in appropriate time relationship with an effective brightness determined by an intensity control cireuit using a photosensitive detector. Situated on one side of the watch is a pushbutton demand switch which, when depressed, instantly activates the appropriate visual display stations. Minutes and hours are programmed to display for one and one-quarter seconds, with just a touch of the demand switch. Continued depression of the demand switch causes the minutes and hours data to fade and the seconds to immediately appear. The seconds continue to count as long as the operator depresses the demand switch. Computation of the precise time is continuous and completely independent of whether or not time is displayed.

Setting is accomplished by actuating either an hour set switch or a minute set switch, both of which are preferably magnetic field responsive reed switches. The hours set switch rapidly advances the hours without disturbing the timekeeping of the minutes and seconds. Actuation of the minute set switch automatically zeros the seconds while advancing the minutes to the desired setting. Calendar or date information is displayed by depressing a second demand button on the other side of the wristwatch case and the calendar information, namely day of the month and month of the year in numerical form as well as the AM or PM of time is displayed when the second demand button is depressed. Also incorporated in the wristwatch of this invention is an arm actuated inertial switch which causes the hours and minutes of time to be illuminated and the time to become visible in response to a predetermined movement of the wearer's arm on which the wristwatch is mounted. The arm actuated switch takes the form of an inertial switch operated by a short, quick motion of the arm in opposing directions in a plane essentially horizontal to the watch face. The inertial switch is provided with a CMOS delay circuit to insure that a deliberate action will cause switch closure, but at the same time to minimize inadvertent actuation of the inertial switch by activity which one would experience during normal routine functions.

The date or calendar circuit automatically counts to 30 or 31 days according to the month of the year and further automatically counts to twenty-nine in February. The time read or first demand switch and the hour set switch are used in conjunction with the date switch to set the calendar. When the hours are set in the watch, the AM/PM of the calendar is automatically reset at AM without changing the date. To set the days, the second demand switch or date switch is depressed so that the date is shown on the display and then the READ or time demand switch is depressed. Days are advanced at one day a second and, at the same time, the AM/PM indication is advanced at the rate of 2Hz. When the first demand switch is released, the days stay set at the desired date and the desired AM or PM. To set the month, the second demand switch (date demand) is depressed to display the date. The hours set switch is then closed to run the month at two months a second rate. When the hour set switch is reopened, the month is set as desired. The display always shows the date, both day and month, in numerical form everytime the date switch is closed and this display is programmed for one and one-fourth seconds in the preferred embodiment in the same manner as the time display.

Important features of the present invention include a unitary timing assembly in which the light emitting diode display elements are mounted on a multilayer ceramic substrate as are the other discreet active components forming the watch electrical circuit. Printed or otherwise deposited on the surfaces of the individual substrate layers is a conductive layer of gold or like suitably configured to form electrical interconnections for the circuit components. Interconnections to the various layers are made by conductive pins passing through the substrate. The entire assembly including display, electrical components and wiring along with the integrated circuit chip which is also mounted on the substrate is potted preferably by coating the assembled elements with a suitable transparent material, such as clear epoxy. The potted assembly is mounted to the insulated watch frame by staking the electrical leads extending from the substrate to the plastic of the insulating frame by ultrasonic heating. The result is a relatively thin compact structure which can be significantly reduced in size without sacrificing any of the desirable characteristics of previous constructions so that it can be used as a relatively small men's or even ladies' wristwatch.

It is therefore one object of the present invention to provide an improved electronic wristwatch.

Another object of the present invention is to provide an improved wristwatch of relatively simplified and inexpensive construction.

Another object of the present invention is to provide a solid state wristwatch of relatively small size.

Another object of the present invention is to provide a completely solid state electronic wristwatch of improved modular construction.

Another object of the present invention is to provide a small wristwatch having a single large scale integrated CMOS circuit chip actuating both a time and calendar display.

Another object of the present invention is to provide an improved solid state timing module in which all of the active components and interconnecting circuitry are assembled as a single unit on a multilayered ceramic substrate.

Another object of the present invention is to provide an improved potted and sealed time and date module for a solid state wristwatch.

Another object of the present invention is to provide an improved wristwatch assembly including an electrically insulating timepiece frame to which is mounted a timing calendar module.

Another object of the present invention is to provide an improved mounting arrangement for a timing module in a solid state wristwatch.

Another object of the present invention is to provide a relatively small solid state wristwatch incorporating a light emitting diode time display, a light emitting diode calendar display, demand and setting switches for both the time an calendar display, and an inertial switch for energizing the time display independent of the other hand or arm of the wristwatch wearer.

These and further objects and advantages of the invention will be more apparent upon reference to the following specification, claims and appended drawings, wherein:

Figure 7A:
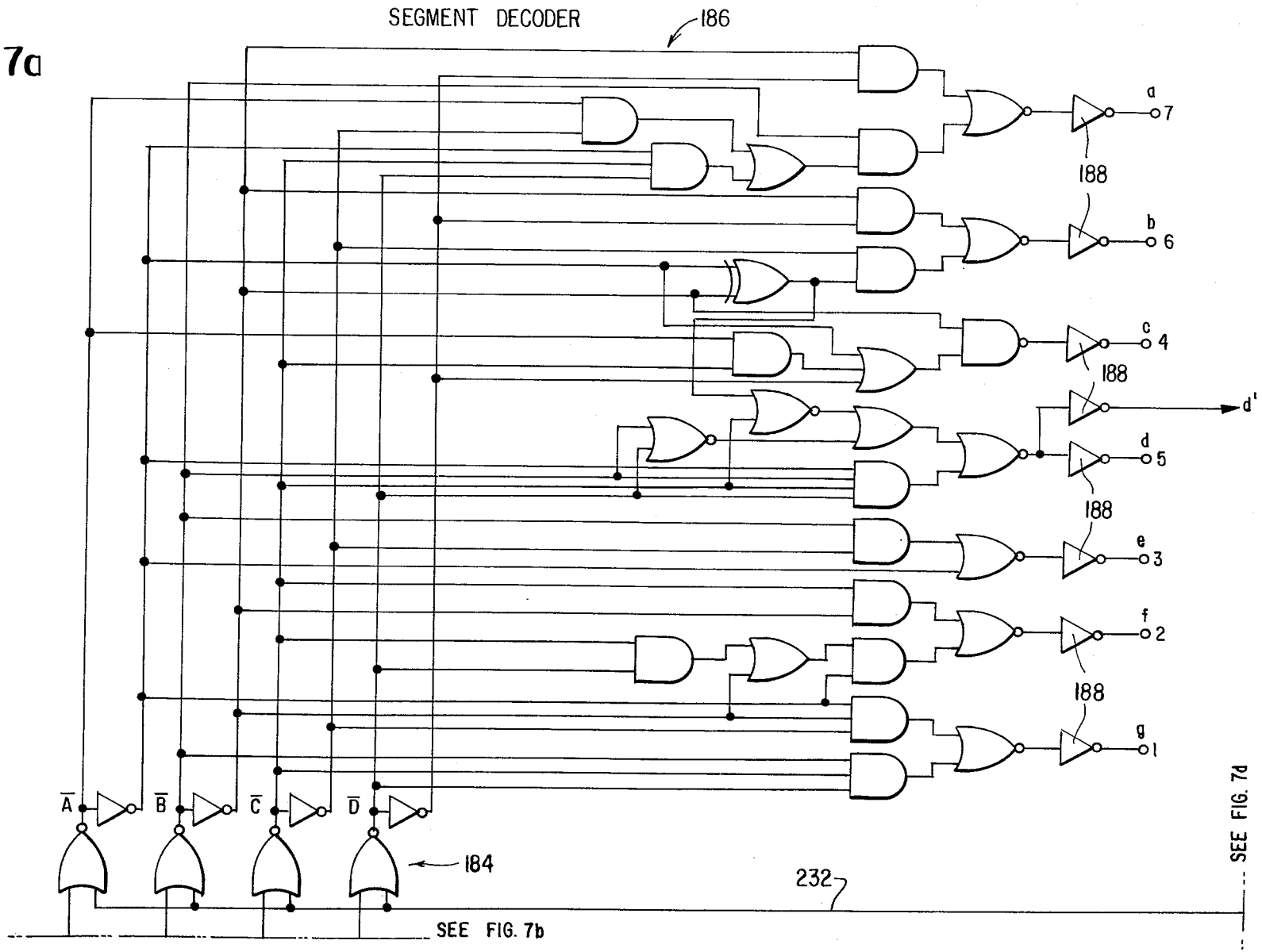
Figure 7B:
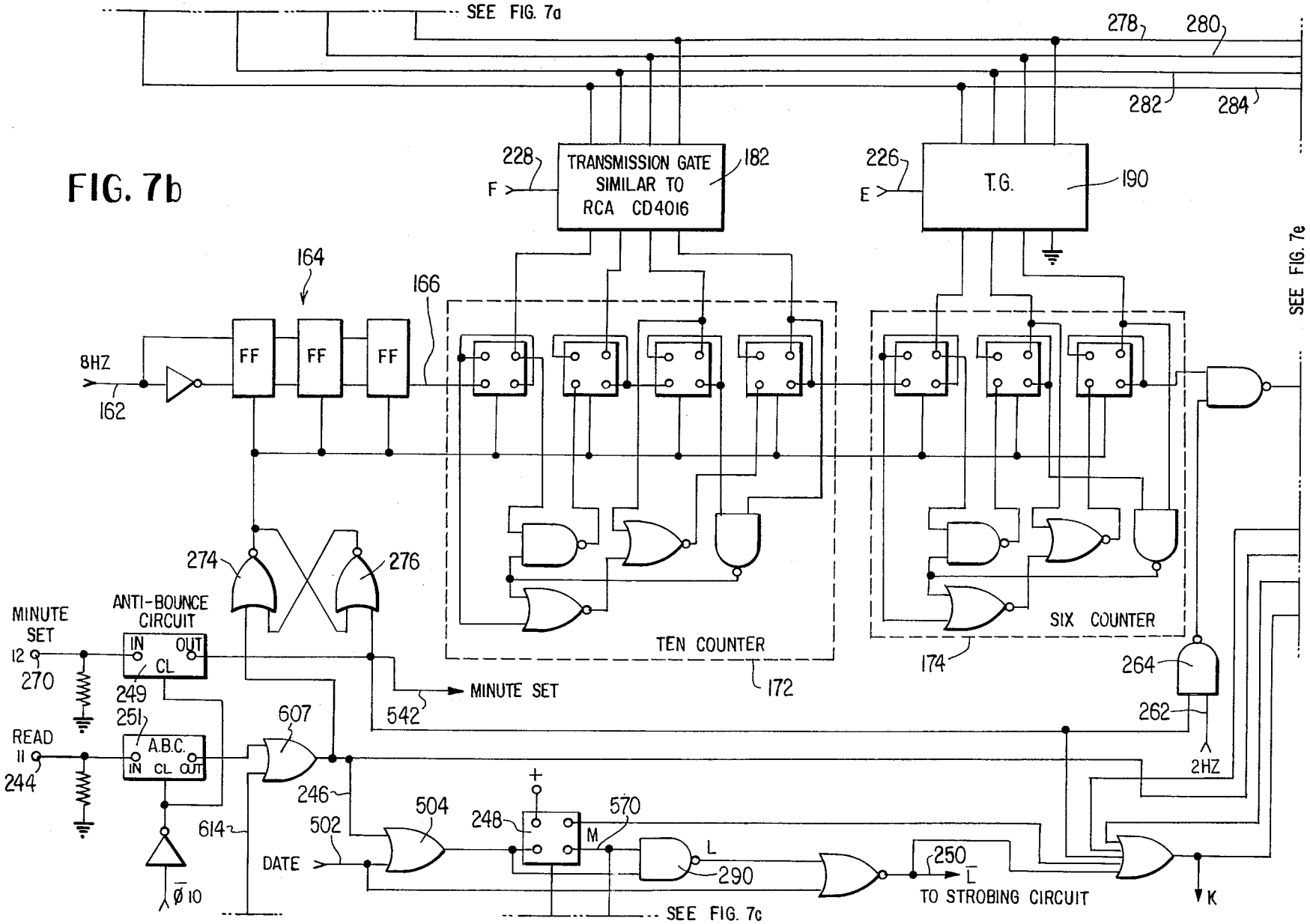
Figure 7C:
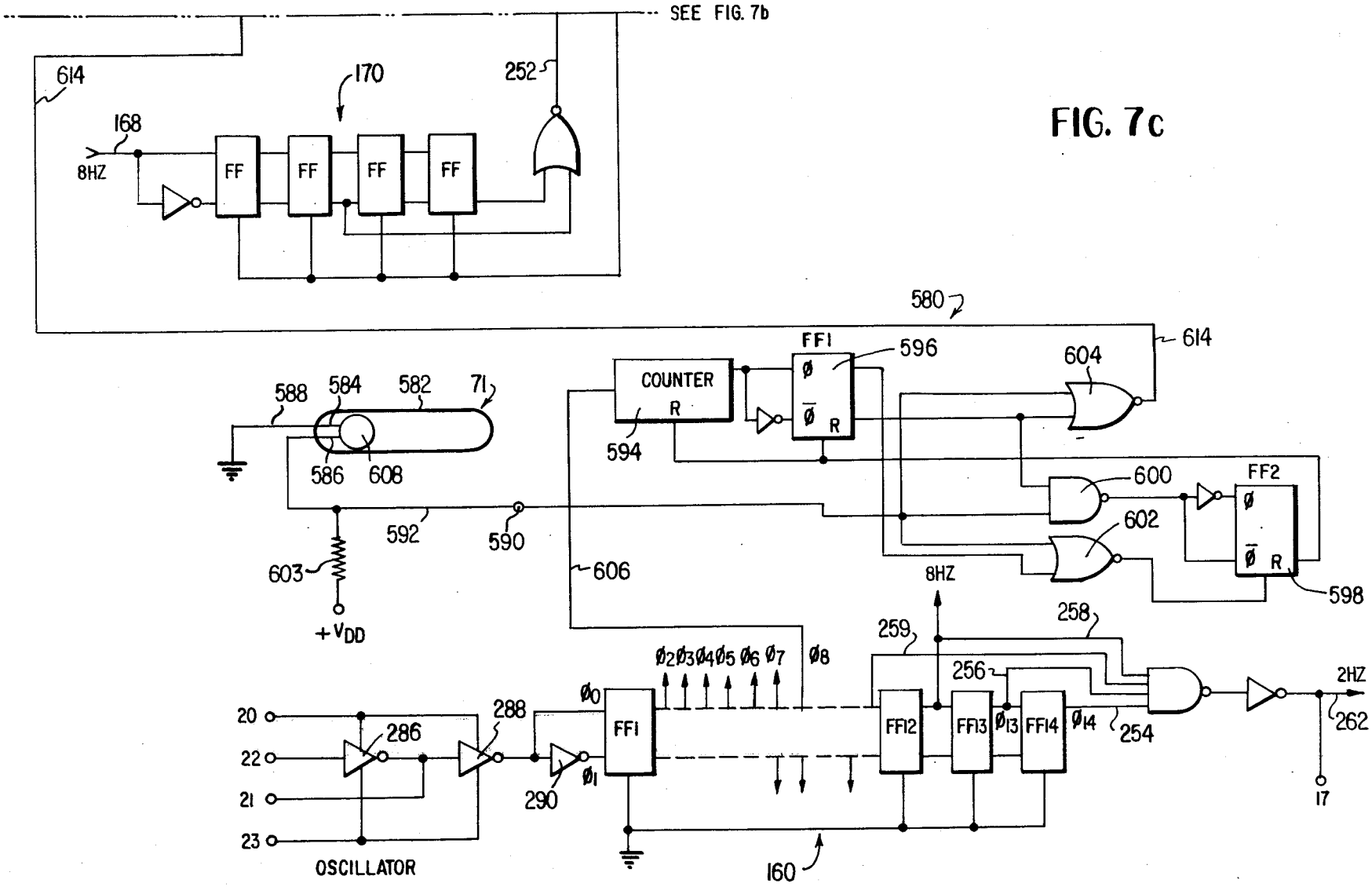
Figure 7D:
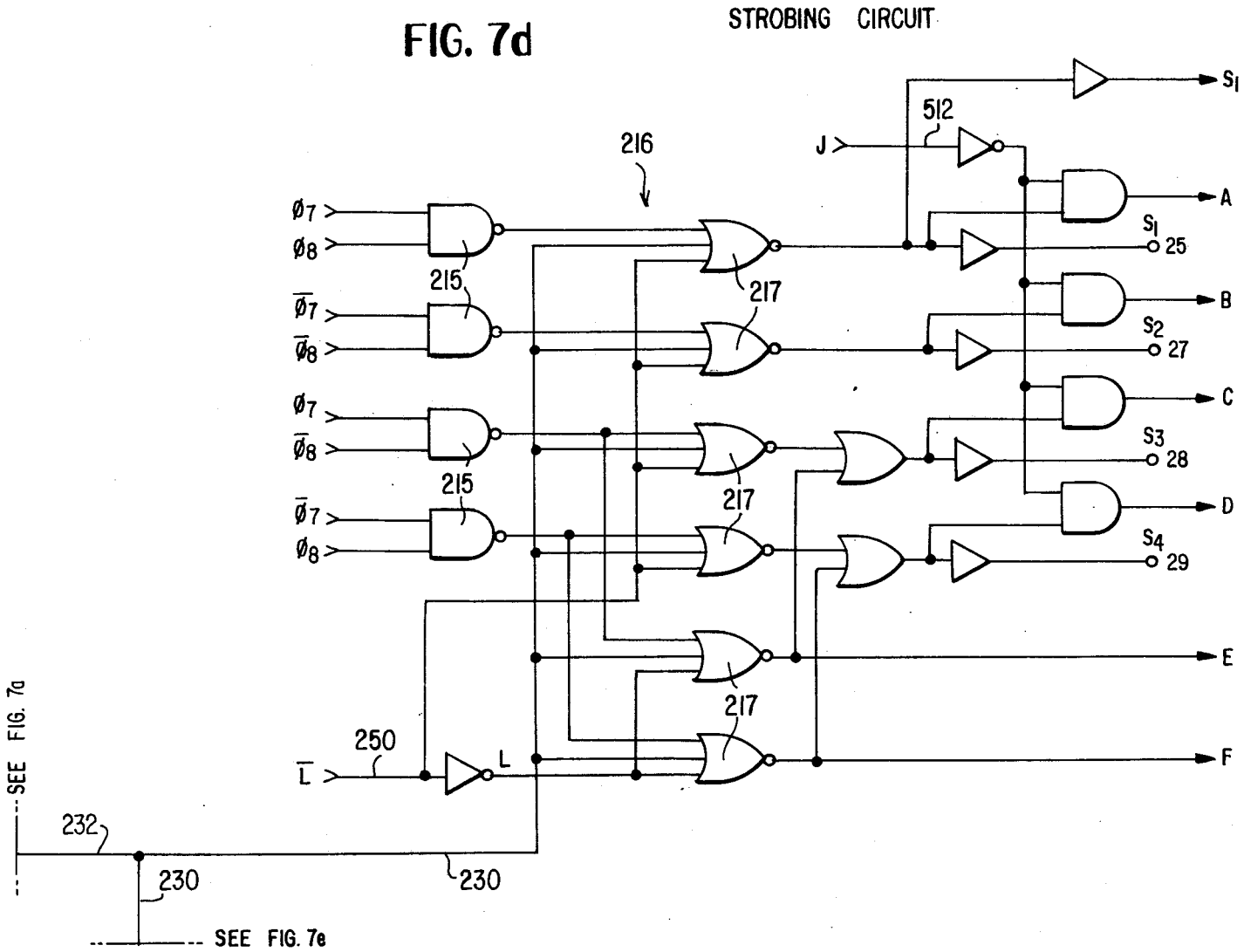
Figure 7E:
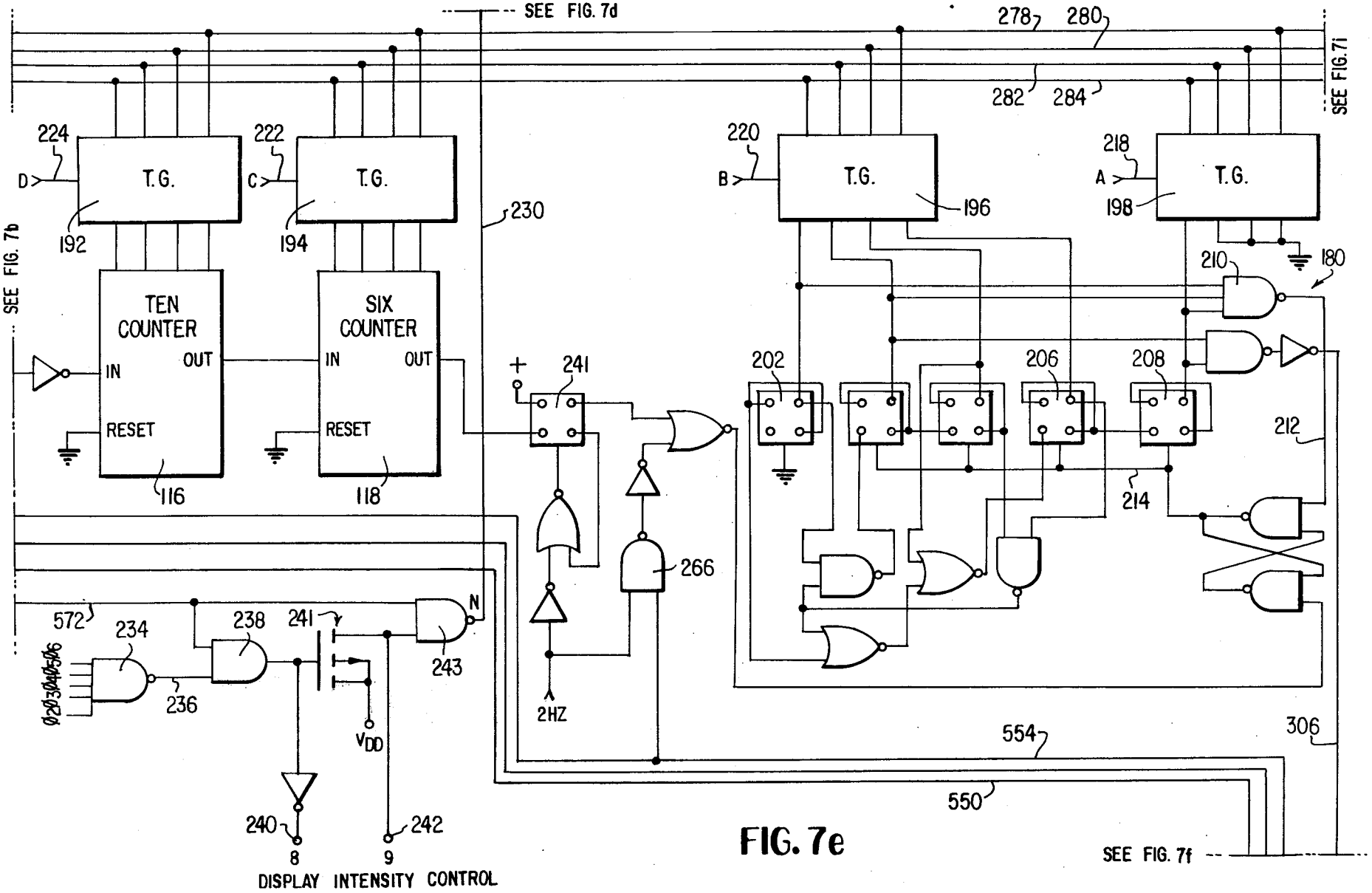
Figure 7F:
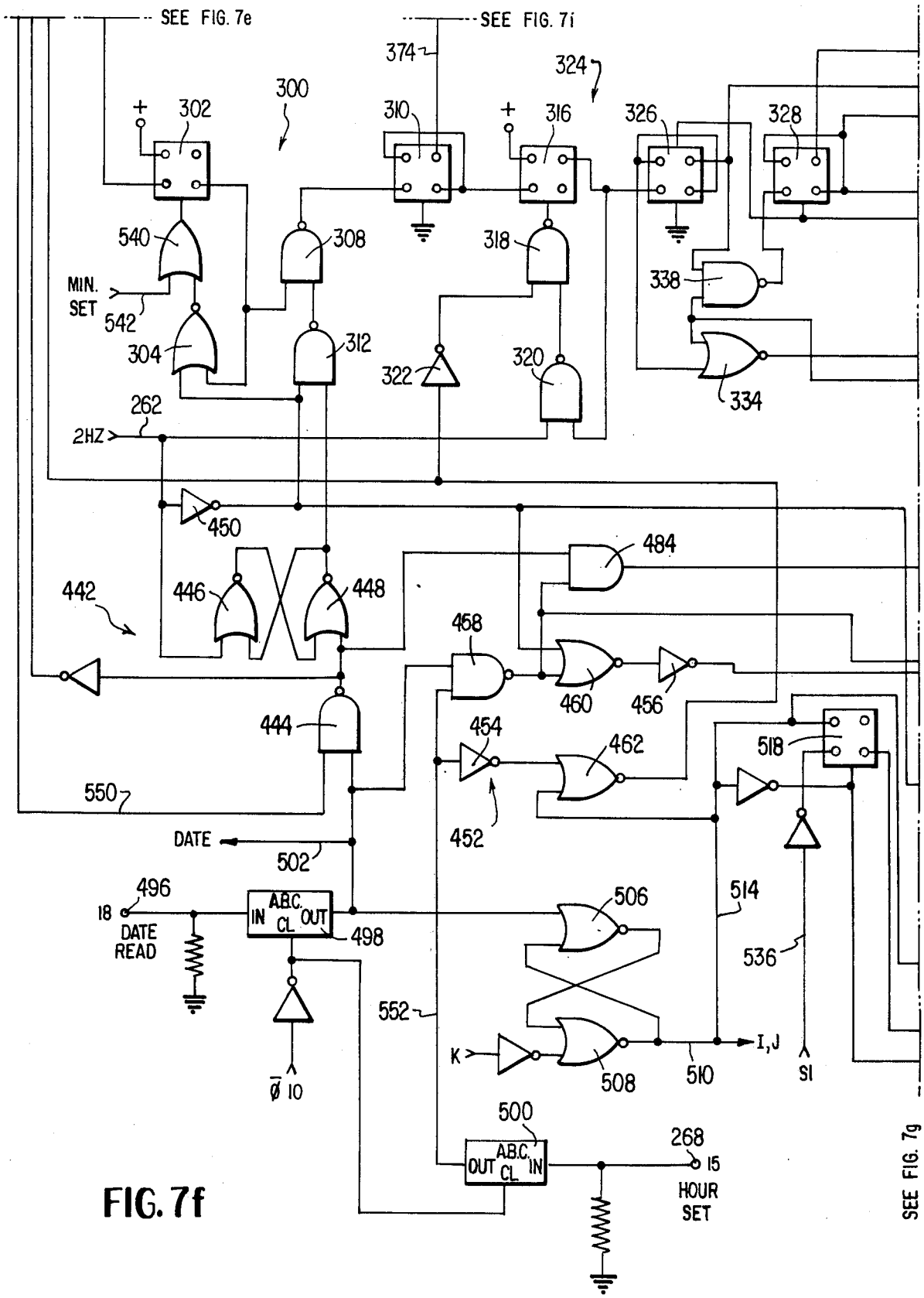
Figure 7G:
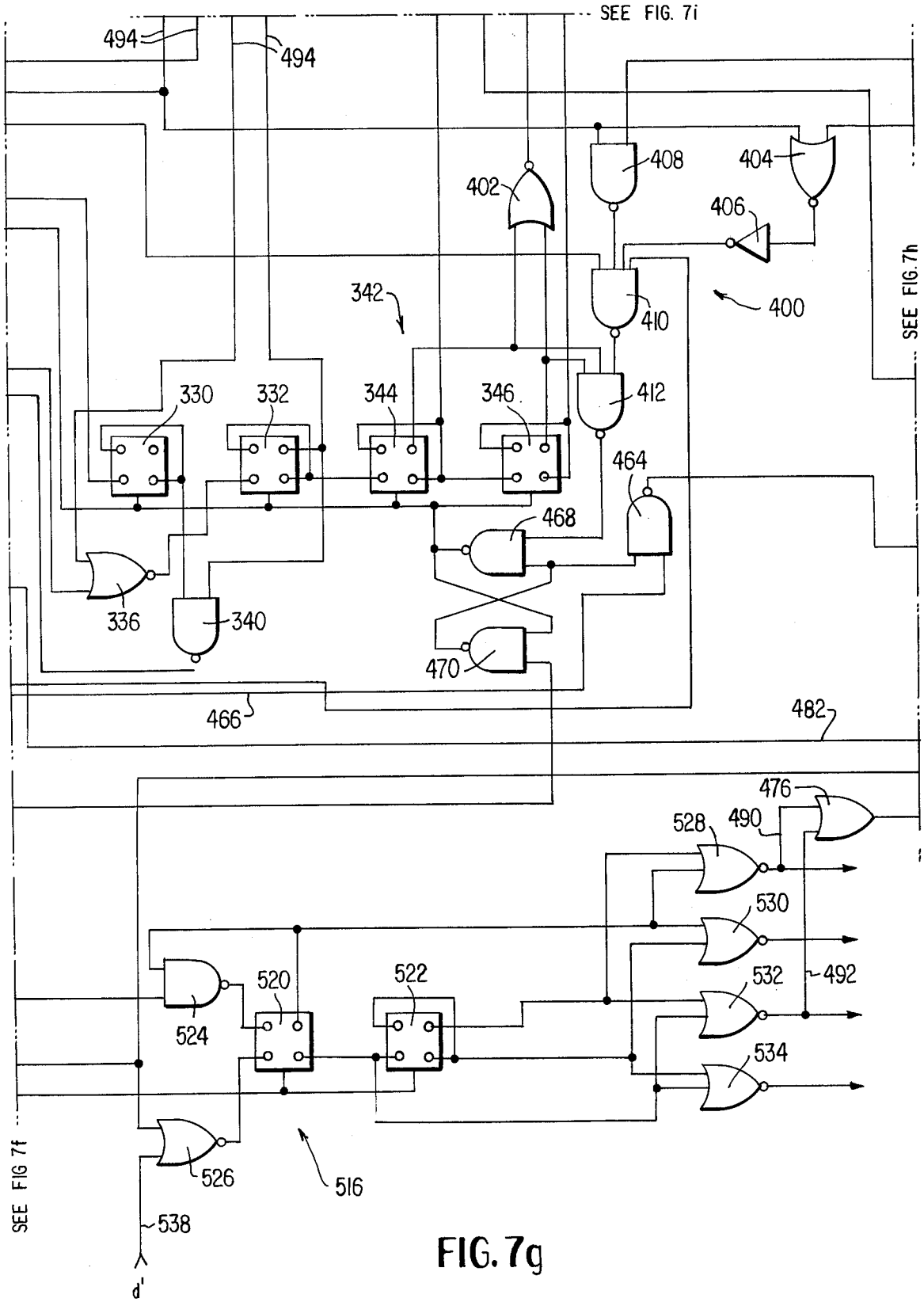
Figure 7H:
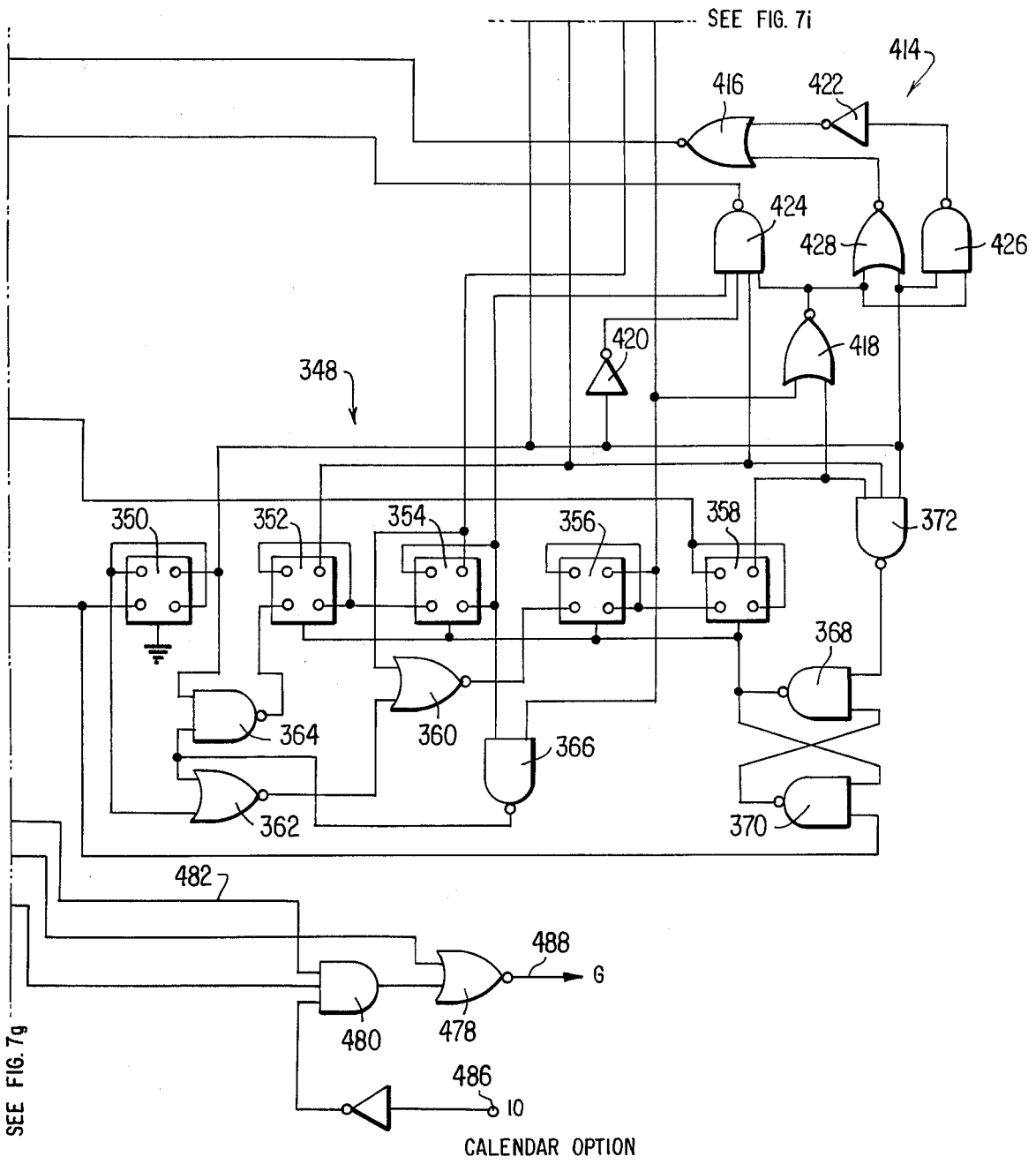
Figures 7, 7I:
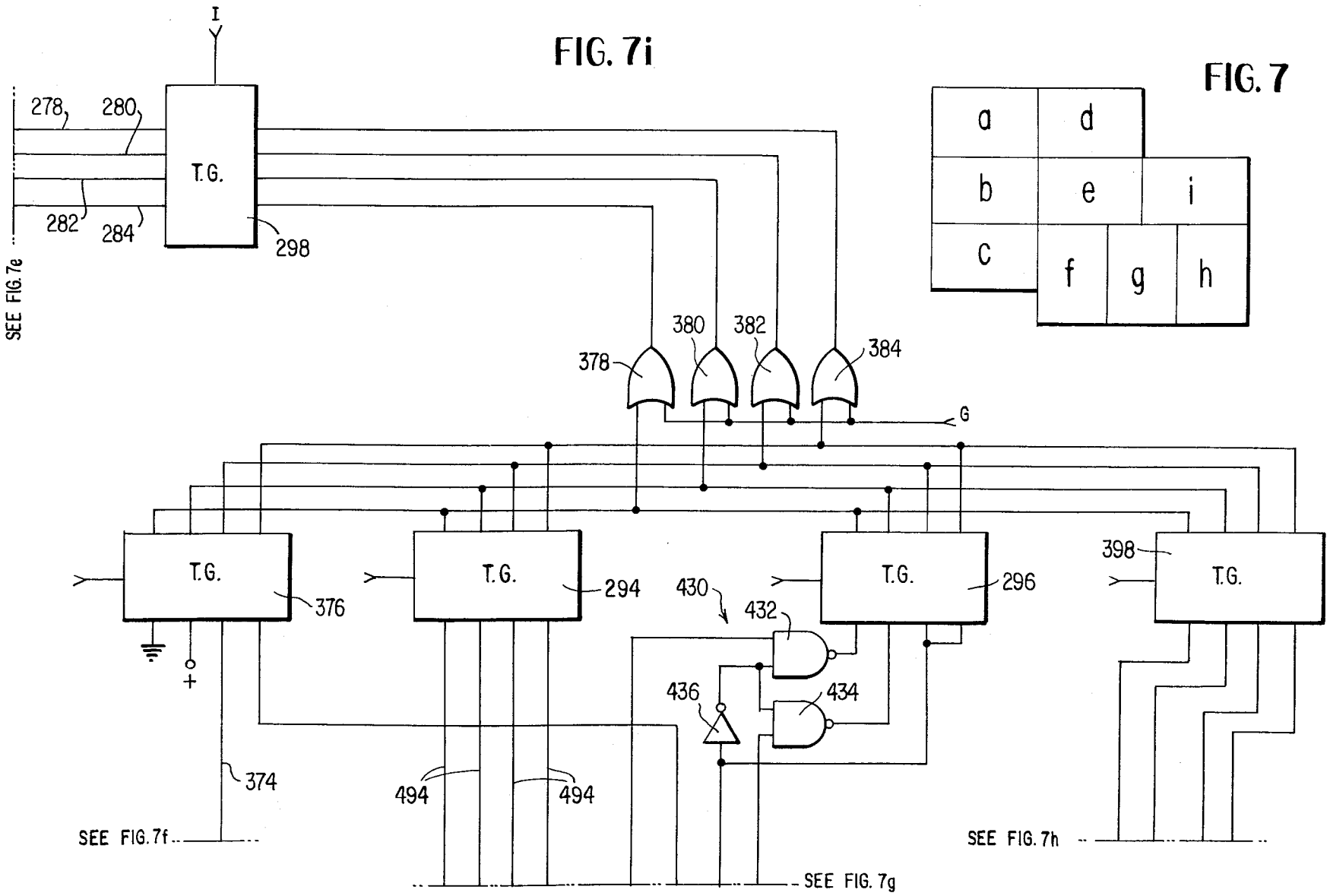
Figure 8:
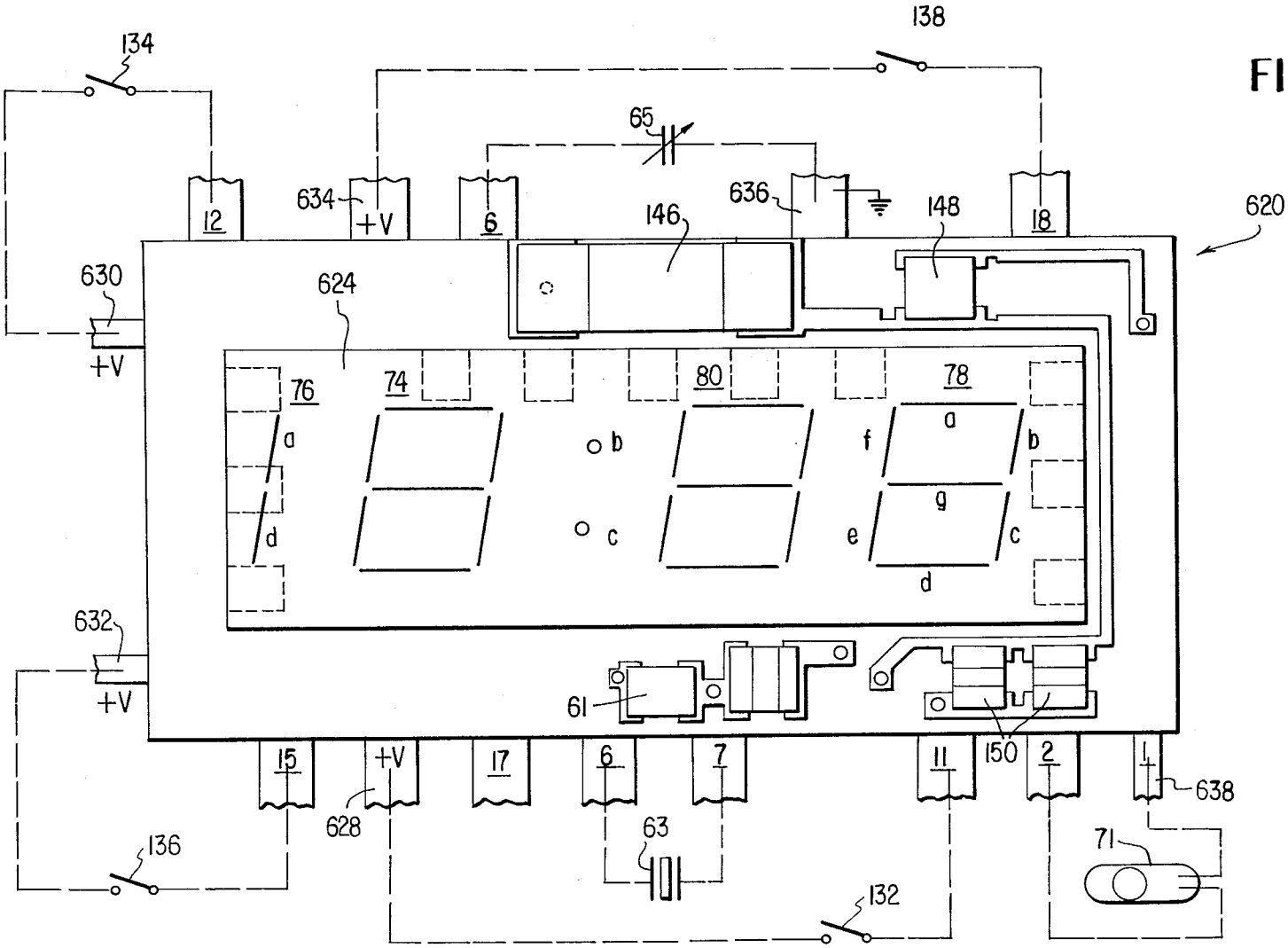
Figure 11:
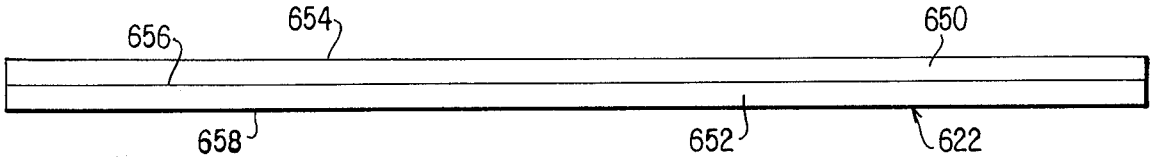
Figure 12:
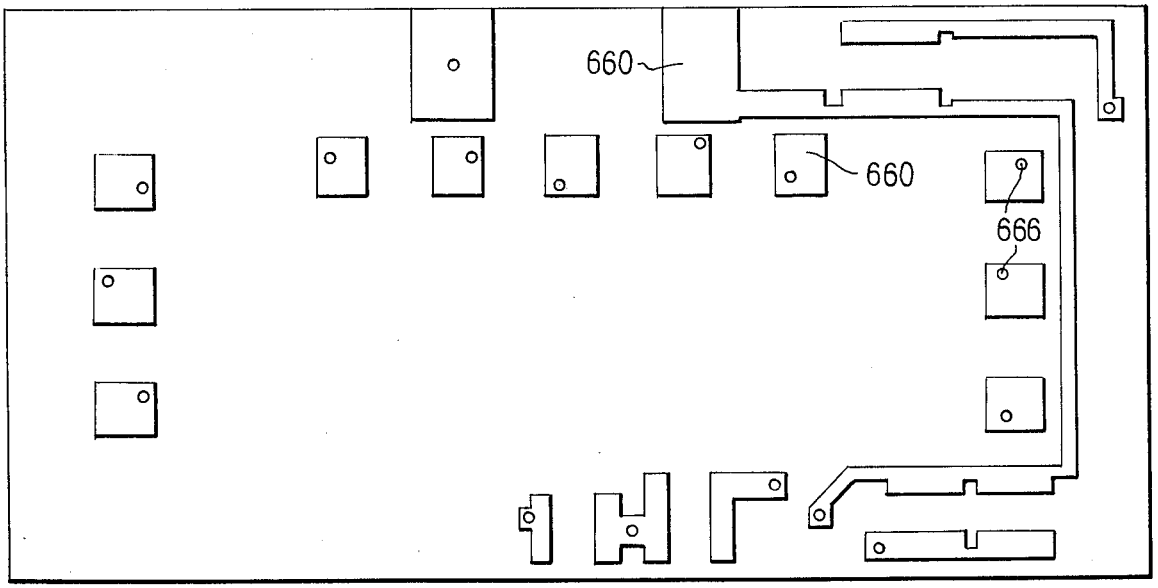
Figure 13:
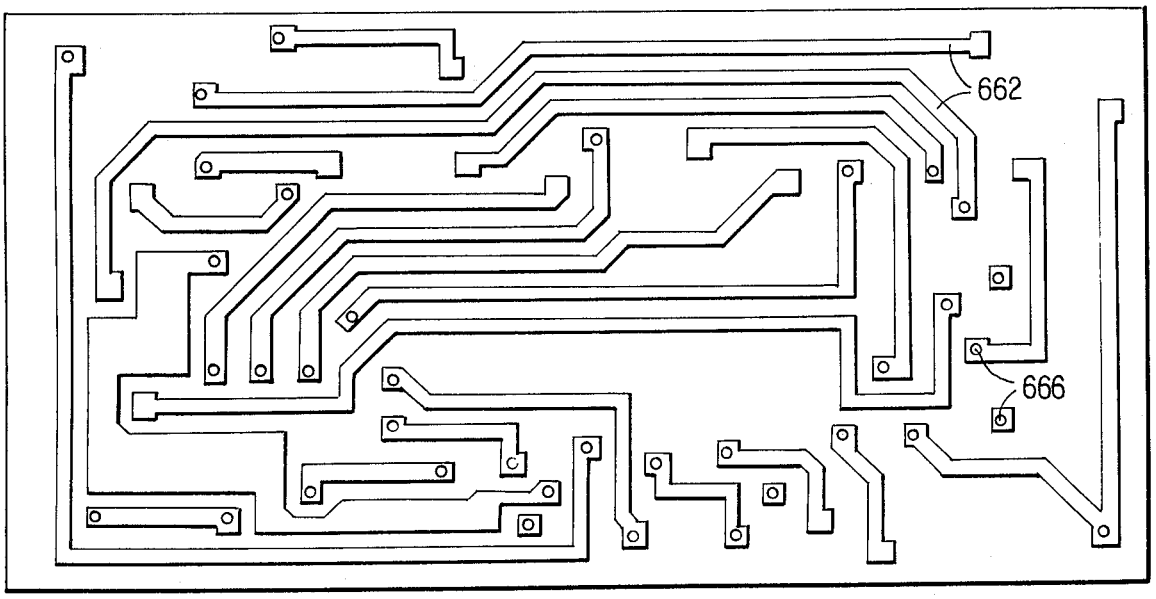
Figure 14:
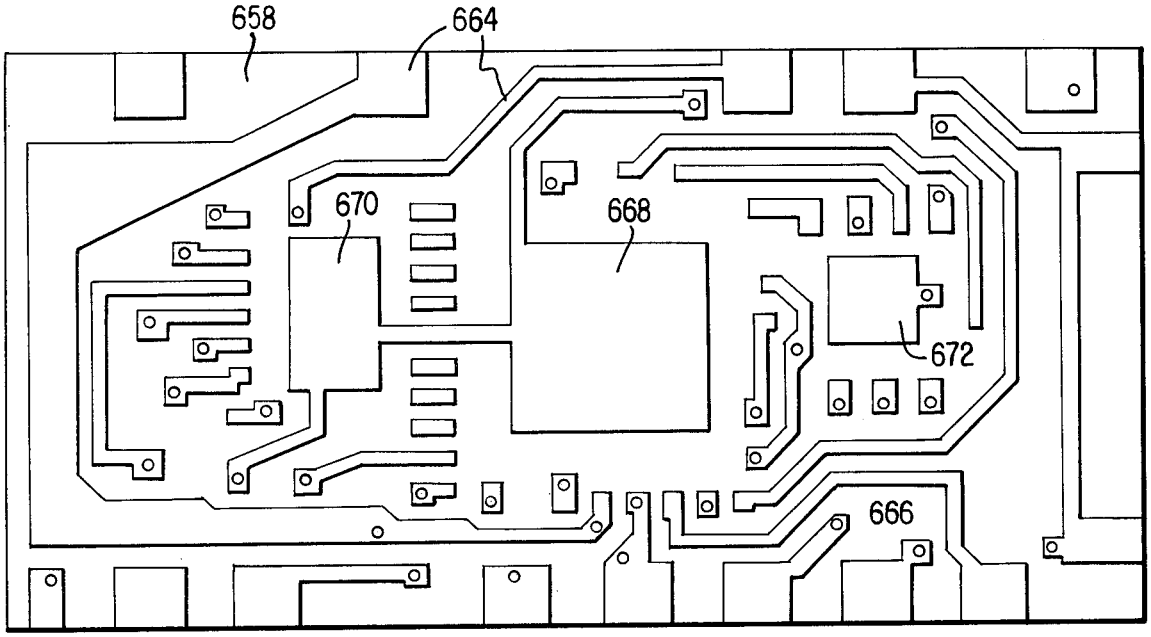
Figure 15:
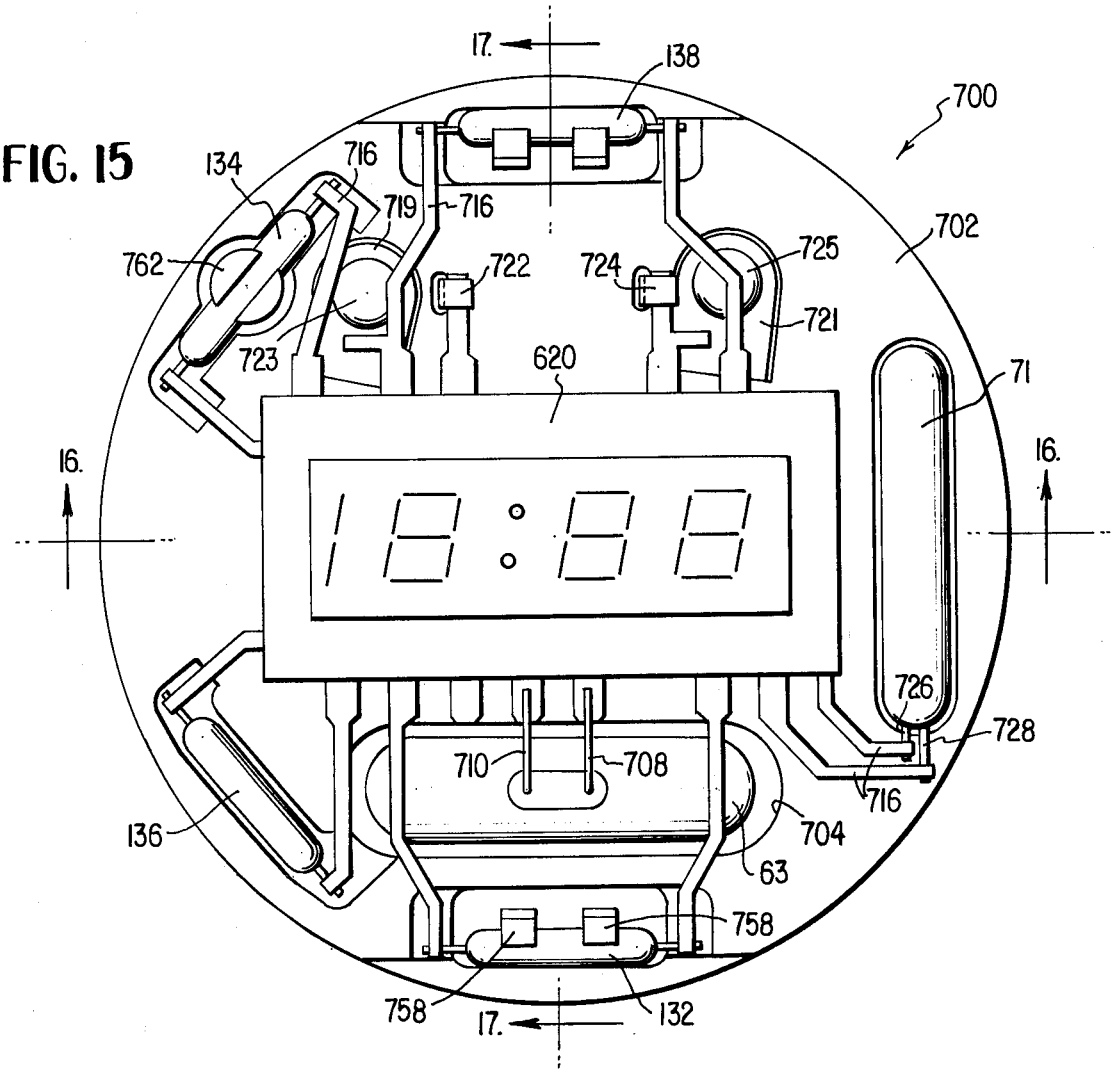
Figure 16:
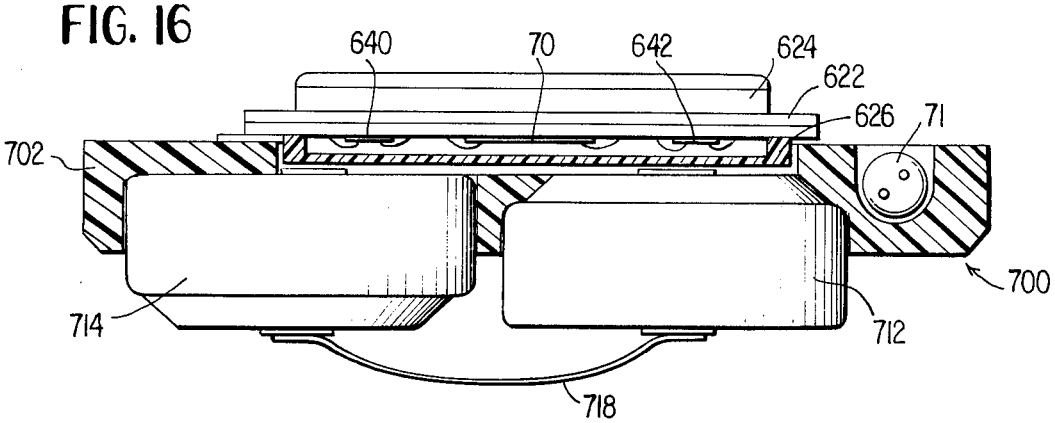
Figure 17:
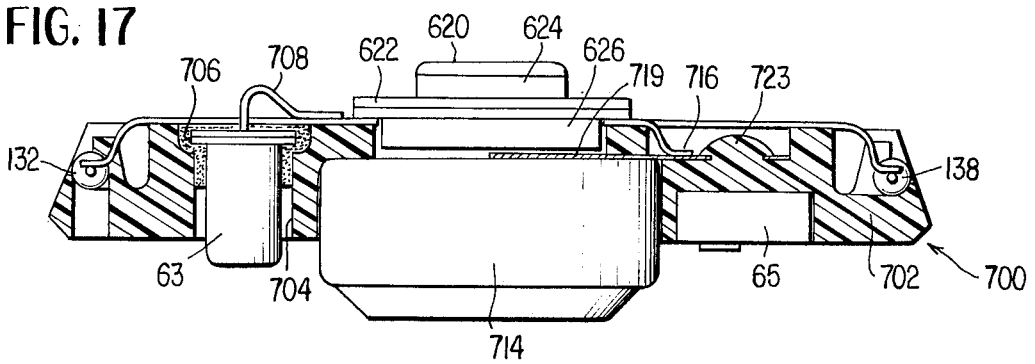
Figure 18:
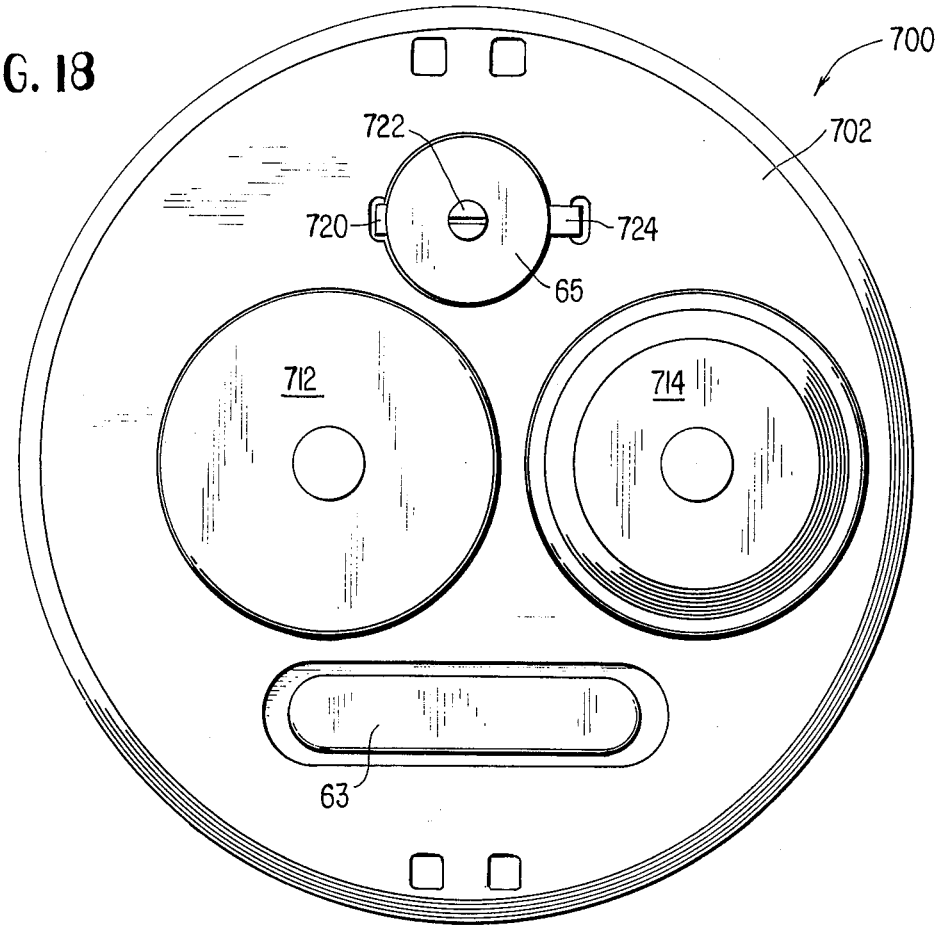
Figure 23:
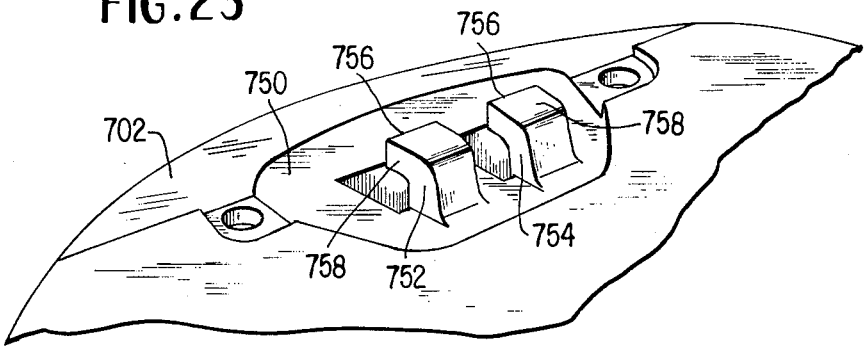
Figure 22:
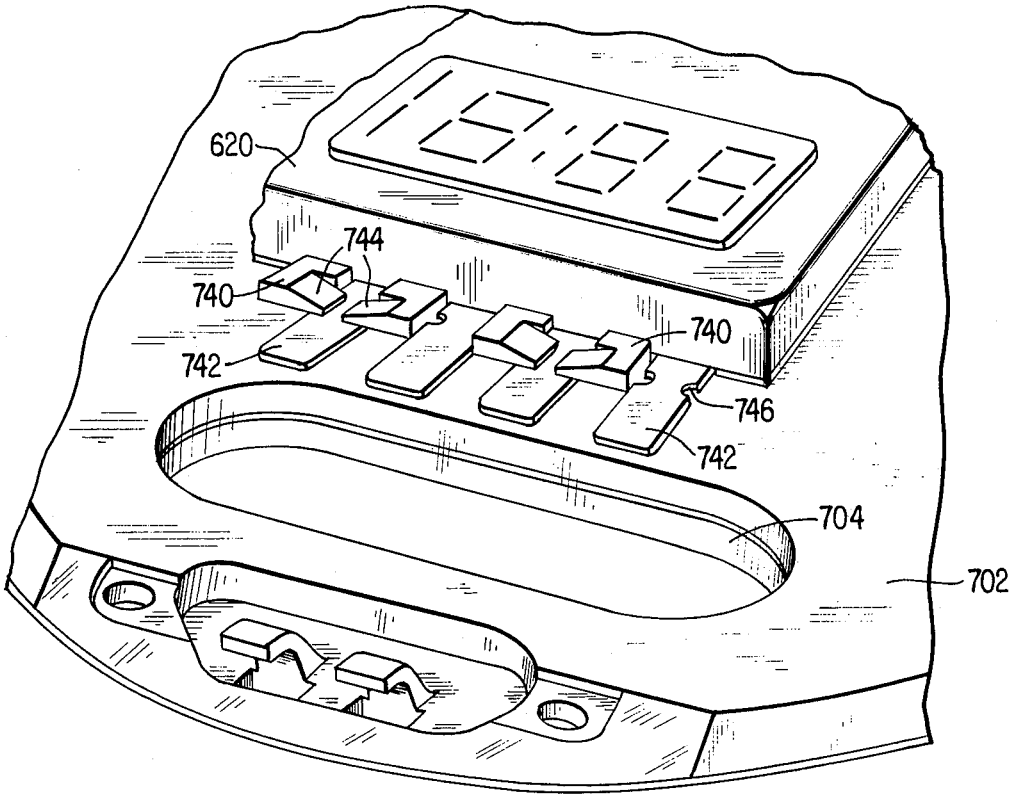

FIG. *7a* through *7i*, when assembled in accordance with FIG. 7, constitute a detailed circuit diagram of the entire wristwatch of the present invention;

FIG. 8 is a top plan view of the timing module forming a part of the wristwatch of this invention;

FIG. 9 is a bottom plan view of the module of FIG. 8 with the dust cap removed;

FIG. 10 is a side view of the module of FIGS. 8 and 9;

FIG. 11 is a side view of the multilayered ceramic substrate forming a part of the module of FIGS. 8 through 10;

FIG. 12 is a top plan view of the substrate of FIG. 11;

FIG. 13 shows the configuration of the intermediate printed circuit layer between the two sections of the substrate of FIG. 11;

FIG. 14 is a bottom plan view of the two layer substrate of FIG. 11;

FIG. 15 is a top plan view of the watch movement of the present invention;

FIG. 15A is a partial cross-section and FIG. 15B is a plan view of one of the battery cell terminals of FIG. 15;

FIG. 16 is a cross-section taken along line 16—16 of FIG. 15;

FIG. 17 is a cross-section of the watch movement taken along line 17—17 of FIG. 15;

FIG. 18 is a rear or back plan view of the watch movement of FIGS. 15 through 17;

FIG. 19 is a plan view of the electrical lead frame for the watch movement prior to trimming;

FIG. 20 is a side view of the lead frame of FIG. 19;

FIG. 21 shows the inertial switch forming a part of the watch of the present invention;

FIG. 22 is a perspective view showing the manner in which the time and calendar module is mounted to the electrically insulating watch frame;

FIG. 23 is a perspective view of a first mounting arrangement for the reed and inertial switches on the watch frame;

FIG. 24 shows a modified support arrangement for the reed and inertial switches;

FIG. 25 is a longitudinal center cross-section through the modified mounting arrangement of FIG. 24; and FIG. 26 is a transverse center cross-section through the mounting arrangement of FIG. 24.

Figure 1:
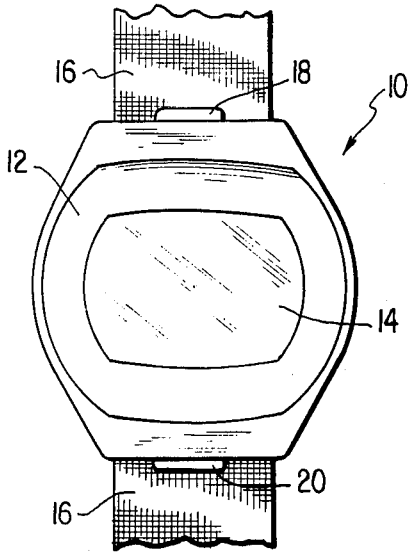
FIG. 1 is a plan view of a wristwatch and a portion of a wristwatch bracelet constructed in accordance with the present invention.

Referring to the drawings, FIG. 1 is a top plan view of a wristwatch constructed in accordance with the present invention. The watch generally indicated at 10 comprises a non-magnetic watch case 12 having a viewing window 14. The window is preferably formed by a suitable red light filter such as a transparent red plastic or ruby material. Attached to case 12 is wristwatch bracelet 16 and mounted on the case is a pushbutton time demand switch 18. Also mounted on the watch case at the edge opposite from the time demand switch 18 is a similar date demand switch 20. Pushbutton switches 18 and 20 are preferably of identical construction and carry permanent magnets so that when they are depressed, reed switches inside the watch case are actuated, as more fully shown and described in U.S. Pat. No. 3,782,102 issued Jan. 1, 1974, the disclosure of which is incorporated herein by reference.

Figure 2:
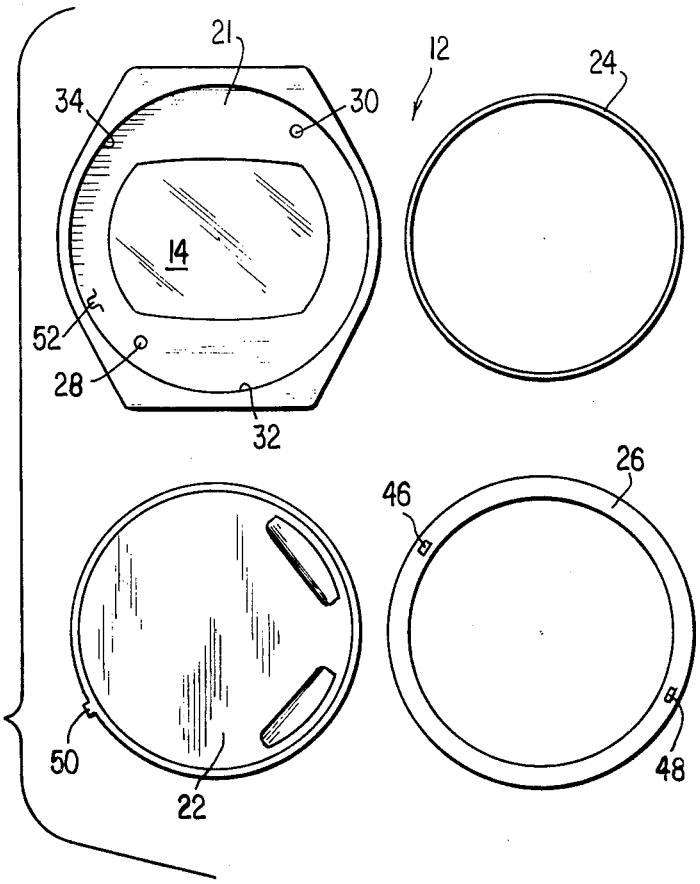
FIG. 2 is an exploded view showing the principal components of the watch case forming a part of the wristwatch of FIG. 1.

FIG. 2 is an exploded view showing the components of the watch case 12. These comprise a cover 21 mounting the red light filter 14, a back plate 22, an O-ring sealing gasket 24 and an externally threaded attachment ring 26. Cover 21 is provided with a pair of mounting holes 28 and 30 which extend only partway through the cover and which are adapted to receive the ends of mounting screws for mounting a module frame inside case cover 21. The cover is internally stepped as at 32 to receive and engage with external threads on attachment ring 26.

Figure 3:
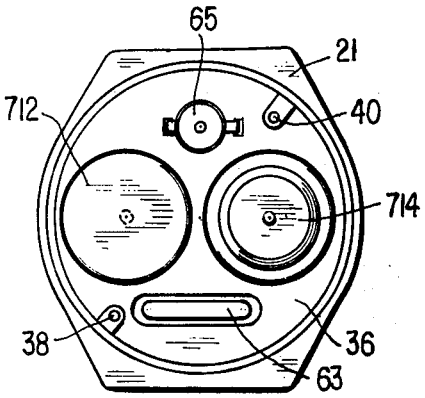
FIG. 3 illustrates the watch case of FIG. 2 with the watch frame inserted in the case.

FIG. 3 shows the cover 21 with a module frame of circular configuration illustrated at 36 as completely received within the cover. Frame 36 is attached to the cover solely by a pair of mounting screws 38 and 40 which pass through the frame and are threadedly received in the mounting holes 28 and 30 of FIG. 2. Frame 36 is provided with a pair of circular cavities 42 and 44, each of which is adapted to receive a one and one-half volt one cell battery. The batteries are connected in series to form a battery power supply of 3 volts.

Figure 4:
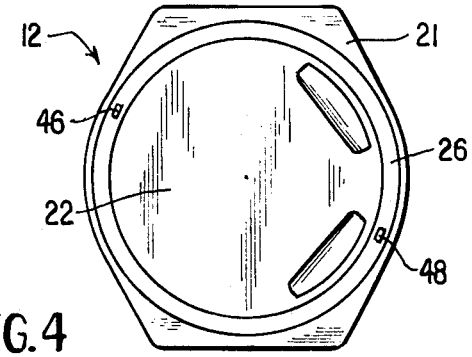
FIG. 4 is a rear plan view of the watch of FIG. 1 showing the watch case completely assembled.

FIG. 4 is a bottom plan view of a completely assembled watch case. As illustrated in FIG. 2, ring 26 is preferably provided with a pair of diametrically opposite indentations 46 and 48 adapted to be engaged by the ends of a bifurcated tool so that the ring may be rotated to tighten the assembly. In assembling the watch, the frame 36 is first inserted into the cover 21 and secured by the screws 38 and 40. O-ring seal 24 is then inserted onto the step 32 in the cover and the back plate 22 is placed over the O-ring seal. Finally, attachment ring 36 is placed so that it overlies the outer edge of back plate 22 and the ring is rotated into tight threaded engagement with the internal threads 34 on cover 21. It is a feature of the assembly that the screws 38 and 40 automatically annularly orient or align the frame 36 with the cover 21 and the viewing window 14. Back plate 33 is preferably also provided with an alignment tab 50 (FIG. 2) which slides into a shallow groove 52 in the cover so that the back plate is also automatically aligned with the cover. Only attachment ring 26 is rotated to tighten the back plate to the cover and compress sealing ring 24.

Figure 5:
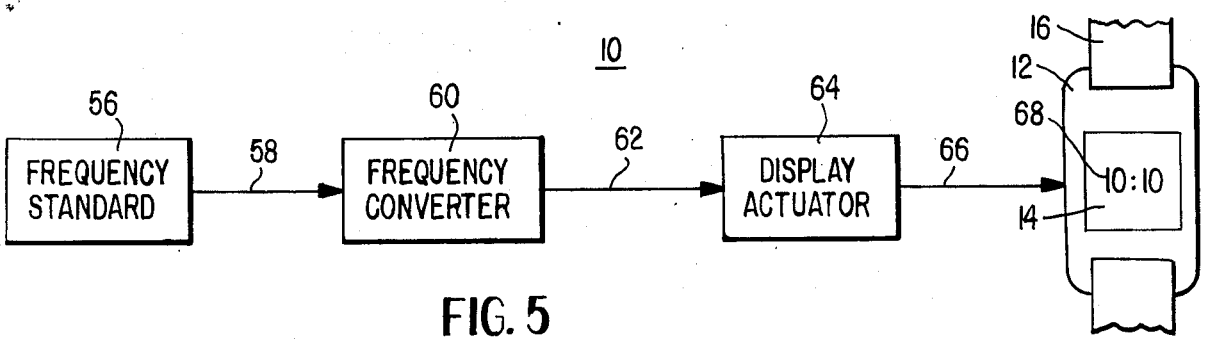
FIG. 5 is a simplified block diagram of the electrical circuit for the timekeeping portion of the wristwatch of this invention.

FIG. 5 is a simplified block diagram of the principal timekeeping components of the watch of the present invention. These comprise a time base or frequency standard 56, preferably in the form of a crystal oscillator producing an electrical output on lead 58 at a frequency of 32,768 Hz. This relatively high frequency is supplied to a frequency converter 60 in the form of a divider which divides down the frequency from the standard 56 so that the output from the converter 60 appearing on lead 62 is at a frequency of 1 Hz. This signal is supplied to a display actuator 64 which in turn drives an electro-optical display indicated at 68 and viewable through window 14 by way of electrical lead 66. While only an hours and minutes display is shown in FIG. 5, it is understood that with the operation of the pushbutton 18 of FIG. 1, the hours and minutes are first displayed for a predetermined time and if the pushbutton 18 remains depressed, the hours and minutes are extinguished and the seconds become visible. The same display diodes are used for both minutes and seconds since these are not displayed simultaneously, thus minimizing the power drain from the watch battery.

In normal operation, time is continuously being kept but is not displayed through the window 14. That is, no indication is visible through the window and this is the normal condition which prevails in order to conserve battery energy in the watch. However, even though the time is not displayed through the window 14, it is understood that the watch continuously keeps accurate time and is capable of displaying this time at any instant. When the wearer or operator desires to ascertain the correct time, he depresses the pushbutton 18 with his finger and the correct time is immediately displayed at 68 through window 14 which shows a light emitting diode display giving the correct time reading of 10:10, namely ten minutes after 10 o'clock. The hours and minutes are displayed through the window 14 for a predetermined length of time, preferably one and one-quarter seconds, irrespective of whether or not the pushbutton 18 remains depressed. The exact time of the display is chosen to give the wearer adequate time to consult the display to determine the hour and minute of time. Should the minutes (or hours) change during the time display, this change is immediately indicated by advancement of the minute (or hour) reading to the next number, i.e., 11, as the watch is being read. If the pushbutton 18 remains depressed at the end of one and one-quarter seconds, the hours and minutes of the display are extinguished, i.e., they disappear and simultaneously the seconds reading is displayed through the window 14 by the same diodes which previously displayed the minutes. The advancing seconds cycling from zero to 59 continue to be displayed through window 14 until the pushbutton switch 18 is released.

Pushbutton 18 is a read switch or a demand switch which is depressed when the wearer desires the time to be displayed. Incorporated in the watch 10 of FIG. 1 is a second pushbutton switch 20 identical in construction and hereafter referred to as the date switch. When the pushbutton 20 of the date switch is depressed, the day of the month, month of the year, and the AM or PM of time are displayed by the same diodes that display time in response to depression of pushbutton 18.

Figure 6:
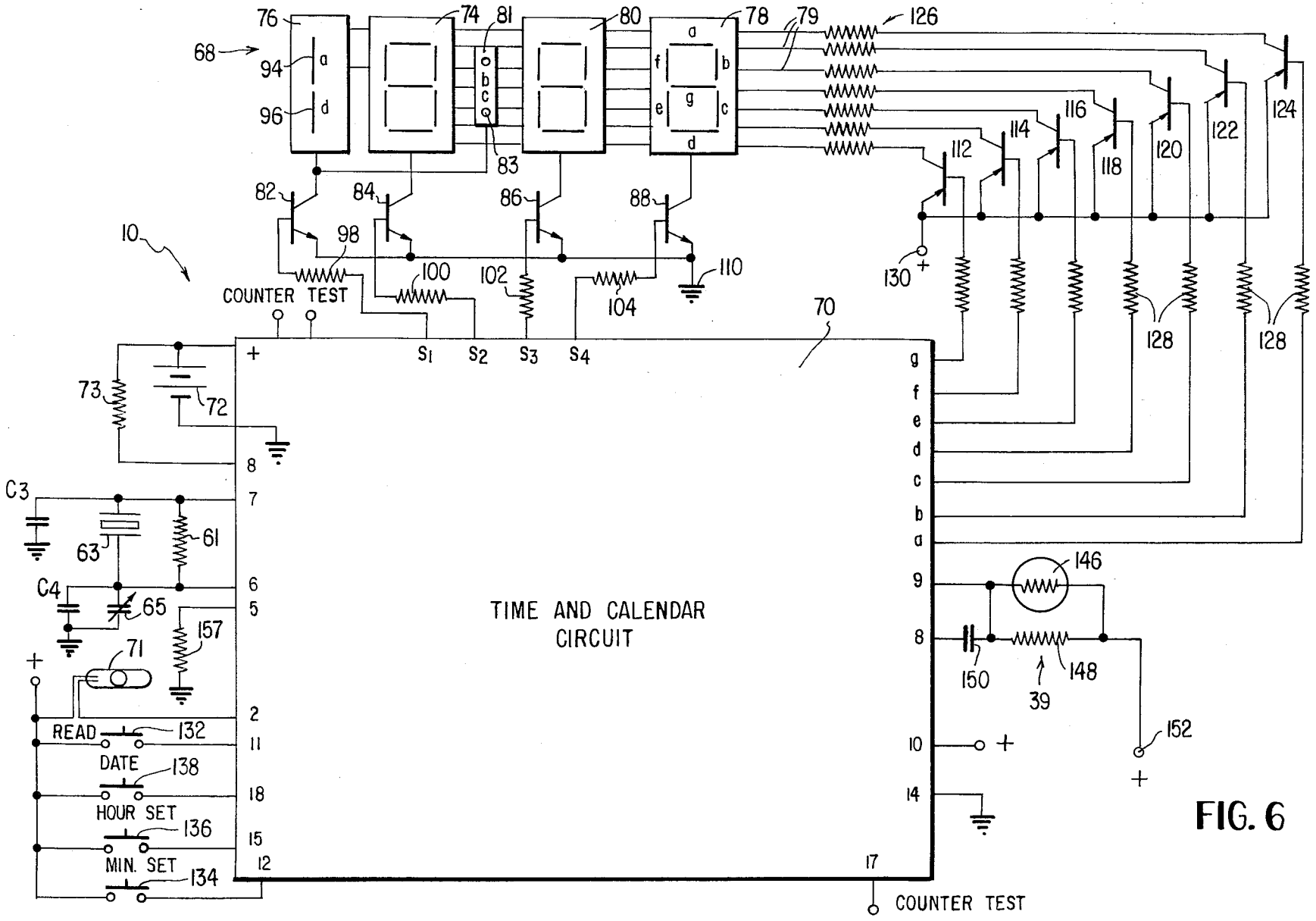
FIG. 6 is an overall electrical circuit diagram of the watch of the present invention showing the large scale integrated CMOS single chip circuit in block form.

FIG. 6 is an overall circuit diagram of the wristwatch of this invention. The watch comprises a large scale integrated circuit 70, preferably in the form of a single integrated circuit chip formed entirely of complementary symmetry MOS transistors. Circuits of this type are presently available from RCA, Hughes Aircraft Corporation, and others. In addition to the large scale integrated circuit 70, the watch comprises a battery 72 which by way of example only may comprise a conventional three-volt wristwatch battery formed from two one and one-half volt cells connected in series. The battery energizes the light emitting diode display 68 which is shown in FIG. 6 as consisting of a pair of hours stations comprising the digits station 74 and tens station 76 and a pair of combination minutes and seconds stations comprising the digits station 78 and tens station 80. The display 68 also includes a pair of colon dots 81 and 83, each formed by a single light emitting diode. Station 78 is formed of a seven bar segment array including the light emitting diode segments labeled "*a*" through "*g*". Stations 74 and 80 are of identical construction whereas the hours tens station 76 is formed from two light emitting diode bar segments 94 and 96. The display stations are energized from integrated circuit 70 connected to battery 72 by way of a plurality of leads 79 to the anodes of the light emitting diodes and the cathodes of the light emitting diodes are individually connected to the other side of the power supply through strobing or switching NPN junction transistors 82, 84, 86 and 88. There is a separate lead 79 for the total number of bar segments in a display station and these leads are connected to a corresponding "*a*" through "*g*" segment of each of the stations 74, 78 and 80. That is, with a seven bar segment display, there are seven leads 79. However, all of the cathodes of each station are connected in common through the NPN junction transistor for that display. The two bar segments 94 and 96 for the hours tens display have their cathodes connected to the transistor 82 as do the colon dots 81 and 83. All the cathodes of hours units stations 74 are connected to transistor 84. Display stations 78 and 80 are used to display both minutes and seconds and station 80 has the cathodes of all diodes connected to the transistor 86 and all the cathodes of display station 78 are similarly connected to transistor 88. These transistors have their bases returned to the integrated circuit 70 through current limiting resistors 98, 100, 102 and 104, the emitters of the transistors being connected in common to ground, i.e., the negative side of the power supply battery 72 as indicated at 110.

The anodes of the bar segment diodes are energized from the bipolar driver transistors 112, 114, 116, 118, 120, 122, and 124. Since the greatest number of bar segments in any display station is seven, there are seven driver transistors and seven leads 79. The transistor collectors are connected to the display diodes through individual ones of current limiting resistors 126 and the driver transistor bases are connected to the integrated circuit 70 through protective resistors 128. The emitters of the driver transistors are connected in common to the positive side 130 of power supply battery 72. The PNP segment driver transistors are preferably formed from a transistor array as are the NPN strobing transistors.

The crystal oscillator or frequency standard 56 of FIG. 5 by way of example only may be of the type disclosed in assignee's U.S. Pat. No. 3,760,584. The components of this oscillator in FIG. 6 external to the large scale integrated circuit 70 are the crystal 63, the variable capacitor 65 (tuning capacitor or trimmer), bias resistors 61, 73, and 157, and the two $\pi$ network feedback capacitors C3 and C4, as illustrated. The circuit of the patent is modified in FIG. 6 to the extent that the variable capacitor 65 is connected in parallel with grounded feedback capacitor C4. The remaining portions of the oscillator 56 are incorporated in the integrated circuit 70 of FIG. 6 as more fully described below. Also external to the integrated circuit is a demand or time read switch 132 which is closed when the button 18 of FIG. 1 is depressed. Further manually operated switches external to the integrated circuit 70 are the minute set switch 134 and hour set switch 136. These switches are connected between the positive side of the battery 72 and the time computer circuit 70 also as more fully described below.

In the watch of the present invention, the intensity of the light emitted from the display diodes is varied in accordance with ambient light. That is, the diode light intensity is increased for greater contrast when the ambient light is bright, such as during day time display, whereas the intensity of the light from the diodes is decreased when ambient light decreases. The automatic display intensity control circuitry is generally indicated at 39 in FIG. 6 and comprises a photosensitive resistor 146 suitably mounted on the face of the watch connected to the positive side of battery 72 and to a resistor 148 and a capacitor 150. Additional switches external to the integrated circuit 70 are the date switch 138 which is closed in response to depression of the button 20 of FIG. 1 and the inertial switch 71 in parallel with the read switch 132 all as more fully described below.

FIGS. *7a* through *7i*, when assembled together as illustrated in FIG. 7, show a detailed block diagram of the large scale integrated circuit 70 of FIG. 6. In these FIGURES, like parts bear like reference numerals.

Referring to FIGS. *7a* through *7i*, the active element of the oscillator illustrated by the CMOS inverter 286 is connected through a pair of further inverters 288 and 290 to provide the complementary outputs $\delta_o$ and $\overline{\delta}_o$ to a binary flip flop divider generally indicated at 160. The oscillator operates at a frequency of 32,768 Hz and the divider 60 is a fourteen-stage nonresettable counter forming the frequency converter 60 of FIG. 5. The counter is formed from fourteen stages of binary flip flops in a counting chain and each stage is comprised of complementary MOS transistors. The output of the twelfth stage of the divider ($\delta$12) having a frequency of 8 Hz is applied by way of a lead 162 to the input of a three-stage resettable counter 164 comprising three stages of MOS complementary symmetry transistor flip flops which produce an output on a lead 166 having a frequency of 1 Hz. The 8 Hz signal from the divider is also applied by way of a lead 168 to a four-stage flip flop decade counter 170, the output of which counter or controlled timer 170 controls a one and one-fourth second timing flip flop 248.

The 1 Hz signal on lead 166 is applied to a seconds unit storage register indicated by the dashed box 172 which divides by tens and whose output is in turn connected to a seconds tens register indicated by dashed box 174 which divides by six. The seconds tens register in turn has its output connected to a minutes units register 176 which again divides by ten and the output of this register is connected to a minutes tens register 178 which divides by six. Register 176 is identical to register 172 and register 178 is identical to register 174 except that the reset leads of registers 176 and 178 are grounded. The output of register 178 is connected to a divide-by-12 hours register generally indicated at 180. These registers are all comprised of binary chains of complementary MOS transistor flip flops and the individual stages except for the control terminals are in all respects similar to the individual stages of the binary dividers 160 and 164. For a detailed discussion of an individual stage forming a stage of either the divider 160, divider 164, or one of the registers 172, 174, 176 and 180, reference may be had to assignee's U.S. Pat. No. 3,560,998.

Output signals indicative of seconds units of time are developed in register 172 and these are applied through a selection gate 182 and through four input gates 184 to a segment decoder 186. The decoder 186 converts the 8-4-2-1 binary coded decimal signals for the displays which are applied to the light emitting diodes of the display through the buffer amplifiers 188. The individual bar segments are labeled "*a*" throgh "*g*" in FIG. 6 and their interconnection is to the correspondingly labeled outputs of the buffer amplifiers 188. While only the segments of station 78 are labeled, it is understood that the outputs of buffer amplifiers 188 are also connected to the corresponding bar segments of stations 74 and 80. That is, the output from the top buffer amplifier 188 is not only connected to the "*a*" bar segment of station 78, but is also connected to the corresponding segment of stations 74 and 80 of FIG. 6. The correspondingly labeled other outputs of buffer amplifiers 188 are connected to the corresponding bar segments of each of the stations 74, 78 and 80. Outputs "*b*" and "*c*" are also connected to the anodes of the colon diodes and the outputs "*a*" and "*d*" on the buffer amplifiers 188 are connected to the anodes of the two diodes 94 and 96 forming the hours tens display. These diodes are simultaneously on or off to display a one or nothing-at-all in correspondence with the hours tens digit of time.

Register 174 in FIG. 7 is similarly connected through a transmission gate 190 to the input gates 184 and to the decoder 186, the input gates 184 and decoder 186 being common to all the registers. Register 176 is connected to the input gates 184 through a transmission gate 192 and register 178 is similarly connected to the input gates through transmission gate 194. Finally, hours register 180 is connected to the input gates through two transmission gates, namely a first transmission gate 196 and a second transmission gate 198.

The time portion of the integrated circuit 70 of FIG. 7 performs the functions of time base generation, time storage, and information decoding, as well as the miscellaneous functions of display timing, automatic intensity control, and display selection. The circuit is designed to operate at 2.2 to 3.2 volts and to use 0.100 inch light emitting diode display. The time base generator portion of the circuit consists of external components (crystal, resistor, fixed capacitors, and trimming capacitor) and an inverter used as an oscillator. The divider comprises a fourteen-stage nonresettable counter 160 as well as the three-stage resettable counter 164. The fourteen-stage counter 160 provides the frequencies used throughout the system to form such functions as timing, setting, resetting, switching, and display intensity control. The three-stage counter 164 is resettable because it acts as a "hold" circuit during minute setting. After the minutes have been set, this counter remains in the reset mode which keeps a signal from passing into the seconds storage register 172 until the time read or demand button 18 of FIG. 1 has been depressed and the read switch 132 of FIG. 6 closed. This counter consists of three stages so that the error upon restarting is no greater than one-eighth of a second.

The time storage portion of the circuit consists of three registers, two divide by 60 and another divide by 12. The first divide by 60 register is resettable and is used to accumulate seconds. Both divide by 60 registers are subdivided into divide by 10 and divide by 6 sections such that the first divide by 60 register is formed by the register sections 172 and 174 and the second divide by 60 register is formed by register sections 176 and 178. This division is provided because the time information must be displayed in decimal numbers. The divide by 12 register 180 displays the numbers 1 through 12 and resets to 1. This is accomplished by making the first flip flop 202 nonresettable. The first three flip flops in combination with the associated logic circuitry forms a divide by 10 section, the next flip flop 206 controls the tens of hours and the last flip flop 208 is used to ensure positive resetting. At the count of ten, eight and two are detected. This sets the tens of hours flip flop 206 and triggers the resetting flip flop 208 which resets stages 2, 4 and 8. Stage 1, i.e., flip flop 202, is already at zero so the units of hours decodes to zero. However, at the count of thirteen, AND gate 210 reads the tens of hours and stages 1 and 2. This toggles the tens of hours flip flop 206 by way of lead 214. Stage 1, i.e., flip flop 202, is not reset and therefore number "1" is decoded. However, this happens so rapidly that the number 13 is never displayed.

In this invention, only one decoder 186 is used in conjunction with a strobing circuit, generally indicated at 216, by means of which the digits are individually strobed. The six strobe outputs labeled A, B, C, D, E and F of the strobe circuit 216 are applied to the corresponding and similarly labeled lines 218, 220, 222, 224, 226 and 228 of the transmission gates 182, 190, 192, 194, 196 and 198 such that these selection gates are enabled in accordance with the strobe outputs. A second set of strobe circuit outputs labeled $S_1$, $S_2$, $S_3$ and $S_4$ are applied as correspondingly labeled inputs in FIG. 6 to the strobe transistors 82, 84, 86 and 88. The strobing outputs are such that the sequence of the display is as follows: (*a*) tens of hours and colon dots; (*b*) units of hours; (*c*) tens of minutes; (*d*) units of minutes; or (*a*) nothing; (*b*) nothing; (*c*) tens of seconds; (*d*) units of seconds if seconds are displayed; and the cycle repeats.

It is apparent from FIG. 7 that a common decoder 186 is used for all numerals to be displayed. The high frequency output of oscillator 56 is lowered in frequency by a series of binary divider stages in divider 60. This divider produces several output frequencies including an 8 Hz output which is fed into the register 164 to produce a 1 Hz output on lead 166. The 1 Hz output is fed into the counting registeres 172, 174, 176, 178 and 180 where it is further divided by 10, 6, 10, 6, and 12, corresponding to the digits needed to display seconds, minutes and hours of time. The binary coded decimal outputs of all the dividers in the counting registers are fed into corresponding selection gates 182, 190, 192, 194, 196 and 198. These gates are controlled by the strobe circuit 216 and the number passing through the input gates 184 into the decoder/driver 186 is determined by this strobe circuit. The outputs A, B, C, D, E and F from strobe circuit 216 applied to the selection gates determine at any instant what timing information is supplied to the diodes. The outputs $S_1$, $S_2$, $S_3$ and $S_4$, applied to the base of transistors 82, 84, 86 and 88 determine what stations display the timing information selected by the selection gates. In addition, the strobing circuit strobes at a greater than visible speed so that a minimum number of diodes are on at any one time while at the same time giving the appearance of a continuous display.

In the operation of the time system, the timer 170 controls the strobing circuit. When the demand switch is depressed, the minutes and hours are displayed for one and one-fourth seconds and if the demand switch remains depressed, the display automatically switches to seconds. Therefore, it is necessary for the strobe circuit to strobe four numerals at any one time, although it controls all six numerals. After the strobing circuit 216 selects the register to be read, the time stored in that register (in binary coded decimal form) passes through the set of selection gates opened by the strobe circuit and through the input gates 184 which act as an interface to the decoder 186. This decoder changes the BCD information into the output necessary to form intelligible numerals. The strobing circuit 216 not only chooses which counting register will be read, but also completes the anode circuit for the corresponding numeral diode. Therefore, only one numeral can be on at any one time but because the strobing action takes place so rapidly, it appears that as many as four numerals are lighted simultaneously.

Divider 160 produces a 256 Hz output ($\delta 7$ and $\overline{\delta 7}$) and a 128 Hz output ($\delta 8$ and $\overline{\delta 8}$) which are applied to selective ones of four NAND gates 215 in strobe circuit 216. These signals are in turn passed through six NOR gates 217 which also receive a signal by way of lead 250 from the timer control flip flop 248. The outputs A, B, C, D, E, and F from strobe circuit 216 are applied to the corresponding set of selection gates 182, 190, 192, 194, 196 and 198 to control which time signals are to be displayed as described above. The other strobe outputs $S_1$, $S_2$, $S_3$ and $S_4$ are applied to the bases of transistors 82, 84, 86 and 88 of FIG. 6 to complete the anode-cathode circuits of the display diodes. In this way, it is possible for the strobe circuit to control which information from which register will pass to the decoder 186 and this BCD information must pass through the input gates 184 which are provided to prevent interference between the several outputs from the selection gates as they enter the decoder. The output of the decoder/driver 186 provides power by way of driver transistors 112, 114, 116, 118, 120, 122 and 124 in FIG. 6 to those segments or display diodes which are to be activated to display the number corresponding to the BCD input number.

Display intensity control is obtained by varying the duty cycle of the strobe drive signal supplied to the strobing circuit 216 by way of a lead 230, this signal also being supplied as an ON-OFF signal by way of the lead 232 to the inputs of gates 184. The signal on lead 232 insures that the diode, even when on, will blink on and off, but at a rate such as 512 Hz so as to give the apperance of being continuously energized. The signal on ON-OFF lead 232 and the strobe drive signal on lead 230 are, therefore, both a 512 Hz signal or series of short width pulses having a repetition rate of 512 Hz in which the pulse width may be varied to vary the average duty cycle of the signal. This is accomplished by taking signals from the second, third, fourth, fifth, and sixth stages of divider 160, which signals are identified as $\delta 2$, $\delta 3$, $\delta 4$, $\delta 5$ and $\delta 6$, and applying them to the five inputs of a NAND gate 234. The output from this gate on lead 236 is a series of 512 Hz pulses having a very short pulse width. These are applied through a NAND gate 238 by way of terminal 240 (labeled terminal 8) to the display intensity control circuit 39 of FIG. 6. Resistor 152 in series with light sensor 146 and parallel resistor 148 gives increased linearity and the circuit in essence acts as a multivibrator which is triggered at a rate of 512 Hz from the divider 160 and NAND gate 234. The length of the output pulse generated by the multivibrator 39 and applied to terminal 242 (labeled terminal *a* in FIG. 7) is determined primarily by the fixed capacitor 150 and the light sensitive resitor 146 in FIG. 6. These 512 Hz pulses, having a variable with and therefore a variable duty cycle in accordance with ambient light intensity, are supplied to strobe circuit 216 by way of lead 230 and as ON-OFF blinking signals to the input gates 184 to control the illumination duty cycle of the display diodes. The duty cycle in each digit is a maximum of 25% modulated by the light control network 39 to as low as 0.78% in the dark (3.12% of 25%). The strobing signals used for the minutes are also used for the seconds since in the preferred embodiment illustrated, the minute display is also used for displaying seconds. A P-channel MOSFET 241 connected between gates 238 and 243 helps to insure complete discharge of capacitor 150.

The display timer is generally indicated at 170 in FIG. 7. This timer automatically turns off the hours and minutes after one and one-fourth seconds. A momentary depression of the read or demand button 18 produces a corresponding closure of the manual switch 132 in FIG. 6 and this completes a setting circuit, i.e., connects B+ to terminal 244 in FIG. 7A, which is connected to timing flip flop 248 through antibounce circuit 249 by way of lead 246 and acts to set the timing flip flop. This flip flop is reset only after the decade counter 170 has counted ten pulses of an 8 Hz signal applied to it over lead 168. As long as flip flop 248 is in the set condition, it puts the proper signal on lead 250 so that only the hours and minutes are displayed. If the read or demand button remains depressed after the decade counter 170 has completed a cycle and supplied a reset signal by way of lead 252, the display automatically reverts to a display of seconds.

Divider 160 is a fourteen-stage binary device and produces a 2 Hz output on lead 254 which is combined with a 4 Hz signal on lead 256, an 8 Hz signal on lead 258, and a 16 Hz signal on lead 259 into NAND gate 260 to produce a 2 Hz setting signal on lead 262 which has a very short pulse width. This signal is applied through NAND gate 264 to the input of minutes register 176 and through NAND gate 266 to the input of hours register 180. Closure of the hours set switch 136 in FIG. 6 applies B+ to terminal 268 of FIG. 7C and the short pulse width 2 Hz setting signal passes through NAND gate 266 to the hours register, setting the hours display at the "fast" rate of 2 hours per second. Closure of minutes set switch 134 in FIG. 6 applies B+ to minutes set terminal 270 of FIG. 7A causing the 2 Hz setting signal to pass through gate 264 to the input of minutes units register 176. This is a "slow" of fine setting with the minutes advanced at 2 per second. A display during setting is assured by connecting hour set terminal 268 and minutes set terminal 270 through NOR gate 272 to the display intensity control circuit connected to terminals 240 and 242. A flip flop 241 is connected between the minutes and hours registers 178 and 180 to act as a pulse shaper. This flip flop and its associated circuit makes the hours setting signal noise free and transforms the long pulse going from the minute counter output to the hour counter input into a 32 millisecond pulse.

Operation of the minutes set switch applies a reset impulse to minute set terminal 270 and through NOR gates 274 to lead 276 which resets counter 164 and the seconds registers 172 and 174 to zero. In this way, the seconds display is automatically zeroed when the minutes are set. Counting is resumed in the seconds register as soon as the pushbutton 18 is depressed and the read switch 132 is closed.

Decoder 186 is used to convert the 8-4-2-1 binary coded decimal signals from the registers into a seven-segment display code for the display stations. It is used for the units and tens of seconds, for the units and tens of minutes, and for the units of hours. As previously described, the tens of hours are either ON or OFF to display a "one" or nothing. The tens of hours display is connected to the a and d outputs of the decoder while the colon is connected to the b and c outputs so that a BCD "one" turns on the colon only and a BCD "zero" turns on the colon and the tens of hours. The proper timing information is generated in the large scale integrated circuit 70 itself.

In the present invention, the decoder 186 is also used to display calender information. That is, the display is used with the decoder to show date and month, AM and PM being shown with one or the other dot of the colon. This date or calendar information is introduced through leads 278, 280, 282 and 284, all under the control of a date transmission gate 298 in the calendar portion of the integrated circuit 70. This gate, when opened, allows calendar information to pass to the decoder 186.

In the present invention, this gate is utilized to provide a calendar display for displaying on the same display stations 74, 76, 78 and 80 (and colon dots) the date, month and AM or PM of time. The month in decimal number is displayed on stations 74 and 76, the day of the month in decimal number on stations 78 and 80. Illumination of colon dot 81 indicates AM of time and illumination of colon dot 83 is used to indicate PM of time. The calendar portion of the circuit is interconnected with the time computer portion of the integrated circuit 70 and with the read or demand switch 132, the minutes set switch 134, the hour set switch 136, and with the date switch 138 which is closed in response to depression of the button 20 of FIG. 1.

The calendar portion of the circuit comprises a pulse shaper indicated generally at 300 and comprising a flip flop 302 and NOR gate 304. Flip flop 302 receives over a lead 306 a pulse signal at the frequency of one cycle every twelve hours. Pulse shaper 300 is connected through a NAND gate 308 to an AM/PM flip flop 310. Also connected to flip flop 310 is a NAND gate 312 to reset flip flop 310 to its AM state when the hours are reset. A flip flop 316 along with NAND gates 318 and 320 and inverter 322 for a short pulse shaper and act as a hold circuit for holding when the hours are set.

A days counter generally indicated at 324 is formed by flip flops 326, 328, 330 and 332 along with NOR gates 334 and 336 and NAND gates 338 and 340. These four flip flops and their gates form a decade counter or days unit counter. They act as a storage register and similarly to the registers previously described are preferably formed as a binary counting chain of complementary symmetry MOS transistors. The days tens counting unit or register section generally indicated at 342 is formed by flip flops 344 and 346. The days counter formed by registers 324 and 342 count automatically to 29, 30 or 31, depending upon the month, in a manner more fully described below.

The month counter is generally indicated at 348 and is comprised of the five flip flops labeled 350, 352, 354, 356 and 358. Also forming a part of the month counter or register are NOR gates 360 and 362 and NAND gates 364, 366, 368, 370 and 372. The month counter 348 counts from 1 to 12.

AM/PM flip flop 310 which acts as a counting flip flop is connected by way of a lead 374 to an AM/PM transmission gate 376 which is in turn connected by way of NOR gates 378, 380, 382, and 384 to the calendar transmission or selection gate 298. These gates constitute the output for the calendar portion of the circuit and supply the necessary AM/PM, day and month information to be displayed by the light emitting diode display stations. NOR gates 378, 380, 382 and 384 act as buffers or interface circuits for interfacing from the calendar portion of the circuit. The BCD output of the days units register 324 is connected to the calendar output through a days units transmission gate 394, the days tens register 342 has its BCD output connected to the calendar output through the days tens transmission gate 396 and the month register 348 has its BCD output connected to the calendar output gate through the month transmission gate 398.

As previously indicated, registers 324 and 342 form a day counter which counts to either 29, 30 or 31 depending upon what month it is. These registers form in effect a programmable counter and the total count is determined by a program circuit generally indicated at 400 which program circuit comprises NOR gates 402 and 404, inverter 406 and NAND gates 408, 410 and 412. The state of the month counter 348 is sensed by a month discriminator circuit generally indicated at 414 and this circuit acts through the program circuit 400 to modify the total count of the days counters 324 and 342. The month discriminator is formed by NOR gates 416 and 418, inverters 420 and 422, NAND gates 424 and 426 and NOR gate 428. Also connected to days tens register 342 is a blanking circuit generally indicated at 430 comprising NAND gates 432 and 434 and inverter 436 which blanking circuit acts to blank out tens of days when the tenths is zero so that instead of displaying zero, nothing is displayed for the tens of days.

The day and month of the calendar circuit are reset at a rate of 2 Hz by means of a 2 Hz signal received from the divider 160 on lead 262. Only the month and day are reset, the AM/PM indication always being returned to AM when the days are set. The day registers 324 and 342 are reset through a day set and antibounce circuit generally indicated at 442 comprising NAND gate 444, cross-connected NOR gates 446 and 448, inverter 450 and NAND gates 312 and 308. The month register 348 is reset through a month setting circuit 452 comprising inverters 454 and 456, NAND gate 458, and NOR gates 460 and 462. Also forming a part of the month set circuit 452 is a NAND gate 464 connected to inverter 456 by way of a lead 466. NAND gates 468 and 470 form a resetting circuit which resets all the counting registers of the calendar circuit to zero with the exception of the first flip flop 326 of the day register and the first flip flop 350 of the month register which are not resettable and are at one. This resetting only occurs when allowed by AND gates 410 and 412 as determined by the month discriminator 414 and its controlled program circuit 400.

Also shown in the calendar circuit is a USA/Europe option. In the USA it is customary to list first the month and then the day. In Europe the listing is customarily reversed. Provision is made in the circuit for blocking out the month display and just displaying the days when the watch is used in Europe. To this end, the circuit is provided with a pair or OR gates 476 and 478 and an AND gate 480. An input of AND gate 480 is connected by a lead 482 to the output of an additional AND gate 484 also forming a part of this circuit. Another input of AND gate 480 is connected to a terminal 486 and the potential at terminal 486 determines whether the watch operates according to the USA of European option. The output of OR gate 478 labeled G and indicated at 488 is applied as an input to the interface OR gates 378, 380, 382, and 384. In the preferred embodiment this European option is not used.

When the potential at terminal 486 is indicative of a binary zero, the USA option obtains and when the potential at terminal 486 is indicative of a binary one the European option obtains. When the potential on terminal 486 equals one (Europe) then the strobing signals $S_1'$ and $S_2'$ on the leads 490 and 492 to OR gate 476 are allowed to pass through gates 480 and 478 unless the calendar is set which setting causes the output of AND gate 484 to become zero thus blocking AND gate 480. This passage through gates 480 and 478 produces an output on lead 488 which is applied to the OR gates 378, 380, 382 and 384. These strobe signals blank the display only when transistors 82 and 84 of FIG. 6 ($S_1$ and $S_2$) would otherwise be energized which causes the display to be blanked out for those two digits. The month signals are blanked but the date signals passed by transistors 86 and 88 ($S_3$ and $S_4$) of FIG. 6 are shown on the display at stations 78 and 80.

When the calendar is set, i.e., when the date switch is closed along with the hour set switch or read switch, then AND gate 484 has a low output, AND gate 480 is blocked and output G on lead 488 remains zero for the time being. The display is "ON", i.e., the month and AM/PM are decoded and read on the display. When the potential on lead 486 is indicative of a binary "zero" then AND gate 480 is blocked all the time and the day and the month and AM/PM are displayed all the time when the date switch is depressed. The potential on terminal 486 is selected for either the USA or the European option by permanently connecting it to either the positive or negative side of the power supply.

In the operation of the calendar circuit at 12 hours, 00 minutes and 00 seconds, the signal on lead 306 goes high and sets flip flop 302 in FIG. 7A. This flip flop is used only to make a short signal (less than 0.5 second) through NOR gate 304 out of a one-hour signal. That is, the output from the hours register on lead 306 is high for one hour, i.e., from 12 hours 00 minutes and 00 seconds to 12 hours, 59 minutes and 59 seconds and flip flop 302 converts this 1-hour signal to a short signal of less than 0.5 second. This short signal through NAND gate 308 drives flip flop 310 which is the AM/PM flip flop. Flip flop 316 makes a short signal from the output of flip flop 310. Flip flops 326, 328, 330 and 332 constitute a decade counter and flip flops 344 and 346 are used for the tens of days. The output from the AM/PM flip flop 310 is applied by lead 374 to transmission gate 376, the output of the days unit counter comprising counter 324 is applied to transmission gate 394 by leads 494 and the output of the days ten counter 342 is applied through gates 432 and 434 to transmission gate 396. These gates in combination with inverter 436 blank out the 10's of days when it is zero. Flip flops 350, 352, 354, 356 and 358 form the month counter 348 which counts from 1 to 12. The month discriminator 414 and control circuit 400 cause the days counters 324 and 342 to count to 30 and 31 during appropriate months of the year and to 29 in February.

The date read terminal 496 in FIG. 7 is connected to the date read or demand switch 138 of FIG. 6 and when that switch is closed, a positive power supply potential from the battery is applied to terminal 496. This impulse is applied to an antibounce circuit 498 which is identical in construction to the antibounce circuits 249 and 251 connected to the minute set terminal 270 and time demand terminal 244 previously described. A similar antibounce circuit 500 is connected to the hour set terminal 268. Each of these circuits receives a signal ($\delta 10$) from the divider 160 and they are provided to insure that signals due to switch closure must have a predetermined width before the corresponding circuit is energized. For example, the antibounce circuits may require a positive impulse due to switch closure having a minimum width of 15 milliseconds before the impulse is passed to the remainder of the circuit. In this way, inadvertent operation of the circuit due to short impulses resulting from noise is eliminated. The output from the antibounce circuit 498 is connected to a date lead 502 which in turn connects to the timing flip flop 248 through NOR gate 504 to start the timer. As previously indicated in the preferred embodiment, both the time display and the calendar display are timed, i.e., when the time demand button 18 is depressed, the hours and minutes are programmed to be on for one and one-quarter seconds and similarly, when the date demand button 20 is depressed, the calendar display is programmed by the same timing circuit to be on for one and one-quarter seconds, irrespective of the condition of the button at the end of this program time period. After one and one-quarter seconds, the calendar display is extinguished until button 20 is released and then again depressed.

Antibounce circuit 498 is connected to a pair of cross-coupled NOR gates 506 and 508 which, when energized, locks up and holds on its output lead 510 a change of state signal labeled "I" "J". The "I" signal is applied to the calendar transmission gate 298 which permits calendar information to pass when its enabling lead "I" is energized by the output of a flip flop formed by cross-coupled NOR gates 506 and 508. This same signal is applied to the "J" input on lead 512 of strobing circuit 216 so that the A, B, C, and D outputs of the strobing circuit are disabled or disappear. Thus, the "I" and "J" signals both allow calendar information to pass to the display and at the same time prevent time information from passing by disabling the time circuit transmission gates 218, 220, 222 and 224. The latching flip flop formed by cross connected NOR gates 506 and 508 is reset by a "K" signal from the output of NAND gate 272 when the calendar display has been timed out by the timing flip flop 248. The "I" and "J" output on lead 510 also is connected by way of a lead 514 to the reset terminals of a calendar gating signal generator generally indicated at 516. This generator comprises three stages of binary flip flops 518, 520 and 522 which, in conjunction with NAND gate 524 and NOR gate 526 generate synchronized gating signals for the calendar transmission gates 376, 294, 296, and 398. These signals are also generated in conjunction with four NOR gates 528, 530, 532 and 534 which produce the outputs labeled A', B', C' and D'. The gating signal generator 516 receives a 128 Hz input labeled S1 on lead 536 from strobe circuit 216 which acts as a common connection for synchronizing the time and calendar displays. This signal passes through the flip flops 518, 520, and 522 and associated logic when a *d'* signal is present on lead 538 from the segment decoder 186, to produce the four sequential pulses A', B', C' and D' for the calendar transmission gates.

Finally, an additional gate 540 is connected to the pulse shaping flip flop 302 at the input of the calendar portion of the circuit. This has connected to its input a minute set lead 542 which receives a signal upon closure of the minute set switch 134 of FIG. 6 so as to disable the calendar registers during minute setting. In this way setting of the minutes does not affect the calendar circuit and cannot result in advancement of the date which might otherwise occur.

In order to set the calendar reading, it is first necessary to close and keep closed the date switch 138 of FIG. 6 by a continued depression of pushbutton 20 which applies a positive voltage or logic "1" to calendar terminal 496 and allows the date and month to be displayed by the diodes. If the read switch 132 is now closed, a logic "1" (B+) is applied to the calendar gate 444 by way of lead 550 and the output of NAND gate 444 goes low and sets the flip flop formed by cross coupled NOR gates 446 and 448. This allows the 2 Hz signal on lead 262 to drive flip flop 310 through gates 308 and 312 by way of inverter 450. This means that a 2 Hz signal is substituted on the CL terminal of flip flop 310 for the input signal which sets the date at 1 Hz and the AM/PM at 2 Hz. To set the month, the same thing is done with the date switch and the hours set switch 136. With both of these switches closed, a logic "1" is applied to calendar lead 496 and to gate 458 by way of lead 552. This signal passes through gates 458, 460, inverter 456, and AND gate 464, substituting for the output of the date counter by way of lead 466 a 2 Hz signal which drives the month counter at a 2 Hz rate. When the hour set switch 136 is closed, a logic "1" is applied to calendar lead 552 and if there is a logic "0" at calendar terminal 496, this produces a logic "1" on lead 554 which is applied to NAND gate 266 to set the hours of the watch and this signal is also passed through inverter 322 and gate 318 to reset flip flop 316 or keep it reset while the gate 312 is ready to let the next short 2 Hz signal reset flip flop 310 through inverter 450 so that the AM/PM counter is eventually reset at AM without changing the date.

In the calendar portion of the circuit the days are accumulated in the counter comprising registers 324 and 342 which is programmed to count either 29, 30, or 31, depending upon the state of the month counter 348. This programming is accomplished through the month discriminator circuit 414 which senses the month in counter 348 and with the program control 400 which programs the days counter in accordance with the month count in register 348 and under the control of discriminator 414. The logic of the available program is based upon the odd or eveness of the month and the number of days in that month according to the following relationship.

| Month | Days | Month | Days |
|---|---|---|---|
| 1st | 31 | 7th | 31 |
| 2nd | 29 | 8th | 31 |
| 3rd | 31 | 9th | 30 |
| 4th | 30 | 10th | 31 |
| 5th | 31 | 11th | 30 |
| 6th | 30 | 12th | 31 |

Discriminator 414 is constructed to detect and determine three different conditions, namely, (1) is the month below 8, (2) is the month odd or even, (3) is the month number 2.

In accordance with the above, five possible states can exist.

a. When a month is below 8 and odd the days counter counts to 31.

b. When the month is below 8 and even but not 2 the days counter counts to 30.

c. When the month is below 8 and even and 2, the days counter counts to 29.

d. When the month counter is 8 or above and odd, the days counter counts to 30, and e. When the month counter is 8 or above and even, the days counter counts to 31.

In February or those years which are not leap years the counter still counts to 29. In those instances at the end of the 28th day in February the wearer must manually set the days and month for the next day. In all other cases, the calendar display automatically advances to the appropriate day and month without any adjustment.

Following is a truth table for the display segment of the light emitting diodes for both time and calendar operation.

TABLE I

| | BCD | | | | Segments | | | | | | | Digits | |
|---|---|---|---|---|---|---|---|---|---|---|---|---|---|
| # | A | B | C | D | a | b | c | d | e | f | g | 1 | 2,3,4 |
| 0 | 0 | 0 | 0 | 0 | 0 | 0 | 0 | 0 | 0 | 0 | 1 | 1: | 0 |
| 1 | 1 | 0 | 0 | 0 | 1 | 0 | 0 | 1 | 1 | 1 | 1 | : | 1 |
| 2 | 0 | 1 | 0 | 0 | 0 | 0 | 1 | 0 | 0 | 1 | 0 | 1 | 2 |
| 3 | 1 | 1 | 0 | 0 | 0 | 0 | 0 | 0 | 1 | 1 | 0 | | 3 |
| 4 | 0 | 0 | 1 | 0 | 1 | 0 | 0 | 1 | 1 | 0 | 0 | | 4 |
| 5 | 1 | 0 | 1 | 0 | 0 | 1 | 0 | 0 | 1 | 0 | 0 | | 5 |
| 6 | 0 | 1 | 1 | 0 | 0 | 1 | 0 | 0 | 0 | 0 | 0 | 1 | 6 |
| 7 | 1 | 1 | 1 | 0 | 0 | 0 | 0 | 1 | 1 | 1 | 1 | | 7 |
| 8 | 0 | 0 | 0 | 1 | 0 | 0 | 0 | 0 | 0 | 0 | 0 | | 8 |
| 9 | 1 | 0 | 0 | 1 | 0 | 0 | 0 | 0 | 1 | 0 | 0 | | 9 |
| 10 | 0 | 1 | 0 | 1 | 1 | 0 | 1 | 1 | X | X | X | | |
| 11 | 1 | 1 | 0 | 1 | X | X | X | X | X | X | X | | |
| 12 | 0 | 0 | 1 | 1 | X | X | X | X | X | X | X | | |
| 13 | 1 | 0 | 1 | 1 | X | X | X | X | X | X | X | | |
| 14 | 0 | 1 | 1 | 1 | 1 | 1 | 0 | 1 | X | X | X | | |
| 15 | 1 | 1 | 1 | 1 | 1 | 1 | 1 | 1 | 1 | 1 | 1 | | |

The first column of the table lists the sixteen decimal numbers obtainable from a 4-bit binary code, i.e., the decimal numbers 0 through 15. The next column labelled A, B, C, D, shows the corresponding numbers in binary code decimal format. The next seven columns labelled *a* through *g* represent the display segments illustrated in FIG. 6. The next column shows the hours tens digits and colon dots whereas the final column shows one of the other three display stations, all three of them being identically connected. The truth table (Table I) indicates what segments must be "ON" or "OFF" (or do not matter) according to the BCD input. An "X" in the table stands for "ONE" or a "ZERO" indicating it does not matter which it is. Because of the way the display is driven a "ON" segment is shown with a "0" and an "OFF" segment with a "1". The first digit at station 76 in FIG. 6 is used to display the tens of hours and the tens of months. In both cases, it displays either nothing or a one. The second digit station 74 is used for the units of hours and the units of months in the calendar. It counts from zero to nine in both cases. The third digit at station 80 is used for the tens of both minutes and seconds and for the tens of days in the calendar. For the tens of minutes and seconds it counts from zero to five. For the calendar it counts from one to three and shows nothing (BCD 15) for a zero on the calendar. Digit 4 at station 78 of FIG. 6 is used for units of both minutes and seconds of time and the units of days in the calendar and in all instances it counts from zero to nine. The colon for the time display is "ON" all the time and the tenths is nothing (BCD 1) or one (BCD 0). A.M. of time for the calendar is shown by illuminating the top dot and p.m. by illuminating the bottom dot of the colon. This is accomplished through the decoder with BCD numbers 2, 6, 10 and 14 in the above TABLE I.

In FIG. 7 the letter M is used to indicate the signal on the outputlead 570 from timing flip flop 248. This signal depends on the timer and $M = 0$ for hours and minutes while $M = 1$ for seconds when the display is off. In FIG. 7, a signal $\overline{L}$ is illustrated on lead 250 which is applied to the strobing circuit 216. The inverse of this signal also appears on the output of NAND gate 291. The signal N on lead 230 in FIG. 7 is the percentage duty cycle as determined by the photoresistor 146 in FIG. 6 plus $\overline{K}$. A signal K appears on lead 572 of FIG. 7 and is applied as a reset signal to the calendar flip flop as previously described.

Also forming a part of the integrated circuit 70 is an inertial switch circuit generally indicated at 580 for the inertial switch 71 of FIG. 6. While the inertial switch 71 itself does not form part of the integrated circuit, it is shown in FIG. 7 for the sake of clarity and explanation. The switch comprises an evacuated glass tube or envelope 582 which, if desired, may be backfilled with an inert gas to control the mechanical viscosity. Projecting into one end of the tube are a pair of electrical contacts 584 and 586, one of which is connected to the negative side of the power supply (ground) by a lead 588 and the other of which is connected to the LSI terminal 590 (pin 2) by a lead 592. Inertial switch circuit 580 comprises a multi-stage resettable counter 594, a pair of resettable flip flops 596 and 598 labeled FF1 and FF2, respectively, a NAND gate 600 labeled N1 and a pair of NOR gates 602 and 604, labeled N2 and N3, respectively. Counter 594 receives a 128Hz input signal from divider 160 by way of a lead 606. Counter 594, by way of example only, may have sufficient counting stages to count the 128Hz input before producing a change of state signal at its output.

In operation, a quick movement of the arm of the wearer in the appropriate direction causes the mercury drop 608 in switch 71 to move from the normal rest position illustrated to the right in glass envelope 582, causing an open circuit between the switch contacts 584 and 586. A positive voltage level is then applied to the inputs of gates 600 and 602 through a resistor 603 labeled R1 and connected to the positive side of the power supply (plus V *dd*). This removes the holding signal from the reset terminal of flip flop 598, and causes the flip flop to be set by the complementary inputs at $\delta$ and $\overline{\delta}$. Setting of flip flop 598 releases counter 594 and flip flop 596 by removing the holding signal from their reset terminals allowing the binary counter 594 and flip flop 596 to count the 128Hz input to the counter.

After a predetermined interval, such as approximately 100 milliseconds, flip flop 596 is set by the counter. After a second similar interval of approximately 100 milliseconds, i.e., after counter 594 completes a second count, its output resets flip flop 596. A second quick motion of the wearer's arm in a direction opposite to that of the first motion causes mercury drop 608 to re-engage contacts 584 and 586 and if this occurs during the time interval in which flip flop 596 is set, a positive voltage impulse is sent to the TIME READ circuit through NOR gate 604 and the OR gate 607 of FIG. 7B. The inertial circuit is put into its original reset state when flip flop 596 is reset by the counter and this resets flip flop 593 by way of NOR gate 602, thus resetting the rest of the circuit.

If the mercury drop 608 re-engages contacts 584 and 586 of switch 71 before flip flop 596 is set by the first count of counter 594, or if the engagement is after flip flop 596 is reset by the second count of counter 594, no signal is sent to the TIME READ circuit. In these two instances, the inertial switch circuit 580 is reinitialized by the resetting of flip flop 598 by way of NOR gate 602 for too early a re-engagement or by way of NAND gate 600 if re-engagement is too late, i.e., after flip flop 596 is reset. Thus, the circuit is disabled for re-engagement of the mercury drop during the first approximately 100 milliseconds, is enabled and produces an output if re-engagement occurs within the second 100 milliseconds, and is disabled thereafter. An output signal on lead 614 is only produced during this approximately 100 millisecond "window" which helps eliminate inadvertent actuation of the display which might otherwise occur. The output on lead 614 operates the time display circuitry in exactly the same manner as momentary closure of the read switch 132 previously described. While the two counting periods for the counter 594 have been described as 100 milliseconds, any suitable number of stages may be provided to give the desired delay and desired actuation window.

The circuit 580 in conjunction with inertial switch 71 makes it possible for the wearer to interrogate the wristwatch and produce a time display of the hours and minutes of time independent of the demand button 18 and therefore independent of the other arm of the wearer. This offers an important convenience feature where the other hand or arm of the wearer may be occupied with packages or the like and the wearer may wish to ascertain the time without depressing demand button 18 and he may do so by a rapid movement of the arm on which the watch is located (either planar or rotary motion) in opposite directions to cause a mercury drop 608 to come out of engagement and then back into engagement with contacts 584 and 586 within a predetermined time interval to limit excessive inadvertent operations of the display and the accompanying drain on the energy of the watch battery.

The mercury drop 608 because of the natural downward inclination of the arm and its tendency to adhere to the contacts 586 and 588 normally tends to assume a position in engagement with the contacts. However, even if the drop is initially spaced from the contacts, the back and forth motion described above will bring it to the position shown and a repeated or second back and forth movement of the wrist or arm will actuate the display. In any event, wristwatches constructed as shown and described have been tested and show good reliability of energization of the hours and minutes display with the first back and forth movement of the wearer's arm while at the same time limiting inadvertent energization of the display to less than 25% of normal demand. Switch 71 is an inertial switch in that it relies on inertial forces to move the mercury drop and requires two successive motion in at least substantially opposite directions within a predetermined time as determined by the delay of the CMOS integrated circuit 580 forming part of chip 70. The switch is actuated by a back and forth motion in a horizontal plane when in normal wearing position on the wrist or by simply twisting the wrist back and forth, thus imparting a sufficient linear component of motion to displace the drop. The drop tends to cohere together to provide some physical damping.

FIG. 8 is a top plan view of the timing module 620 forming the basic element of the wristwatch 10 of FIG. 1. The module comprises a two piece or laminar ceramic substrate 622 on which is mounted a light emitting diode display package 624. In FIG. 8, like parts bear like reference numerals. FIG. 9 is a bottom plan view of the module 620 and FIG. 10 is a side view. In FIG. 9, the dust cover 626 (FIG. 10) has been omitted for the sake of clarity. In FIG. 8, the substrate has extending from it a plurality of conductive electrical tabs to which have been applied the same pin numbers as appear in FIG. 6. In addition, the various switches 71, 132, 134, 136 and 138 are shown in dashed lines as connected to these pins. Similarly shown is a variable capacitor or trimmer 65 and the oscillator crystal 63. For example, time read switch 132 is shown in dashed lines as connected between a positive conductive tab 628 and the tab bearing pin number 11. Minute set switch 134 is connected between a positive power supply tab 630 and a tab bearing pin 12, power set switch 136 is connected between a positive power supply tab 632 and a tab bearing pin 15 and date read switch 138 is connected between the positive power supply tab 634 and a tab bearing pin number 18. Trimmer 65 is connected between a tab bearing pin number 6 and grounded tab 636 whereas crystal 63 is connected between electrically conductive tabs bearing pin numbers 6 and 7. The tab bearing pin number 17 provides a test point output connection at a frequency of 2 Hz. The inertial switch 71 is connected between the tab bearing pin number 2 and a positive power supply tab 638.

FIG. 9 shows the underside of the module 620 upon which is mounted the integrated circuit chip 70. Also mounted on the substrate 622 is a segment chip 640 and a digit or station chip 642. Chip 640 is a driver transistor array and is comprised of the transistors 112, 114, 116, 118, 120, 122 and 124 along with their associated resistors 126 and 128 of FIG. 6. Digit chip 642 similarly comprises a transistor array including transistors 82, 84 and 86 of FIG. 6 along with their associated resistors 98, 100, 102 and 104. Each of the chips 70, 640 and 642 is wire bonded to the substrate 622 as indicated by the wire bonds 644 in FIG. 10. In final assembly, the circuit chips are covered by a plastic dust cover or cap 626 which is secured to the substrate 622 by suitable adhesive 646 such as epoxy or the like to prevent the entry of dust and dirt and to provide physical protection for the electrical circuit chips and associated wiring. Secured to the other side of the ceramic substrate 622 by epoxy or the like (not shown) is the light emitting diode display package 624. While a single unitary LED display 624 is shown, it is understood that the stations 74, 76, 78 and 80 may be individually secured to the substrate 622 if desired, rather than as a unit as shown.

FIG. 11 is an edge view of the ceramic substrate 622. It is preferably made from two layers 650 and 652 joined by epoxy or the like, formed of a suitable black ceramic material and which carries on three surfaces 654, 656 and 658 separate electrical circuits, such as a suitable gold or gold alloy printed circuits eutectic bonded to the ceramic. By way of example only, a first printed circuit 660, illustrated in FIG. 12, may be formed on the top surface 654 of ceramic layer 650, a second printed circuit 662 illustraded in FIG. 13 may be bonded to the back surface 656 of upper ceramic layer 650 and a third printed circuit 664 illustrated in FIG. 14 is bonded to the lower surface 658 of lower ceramic layer 622. The ceramic material of the layers 650 and 652 not only act as a good physical support for the printed circuits, but provide excellent electrical insulation between the circuits. Interconnections between the circuits are formed by electrical conductive pins passing through the layers 650 and 652 to engage the printed circuits 660, 662 and 664 where electrical connections are made as indicated for example at 666 in FIGS. 12, 13, and 14. In FIG. 13, the large scale integrated circuit chip 70 is bonded to gold pad 668, the PNP transistor array 640 is bonded to gold pad 670, and the NPN transistor array chip 642 is bonded to conductive gold pad 672. The wire bonding to the gold printed circuit 664 from these transistor chips is by the wire bonds 644 of FIG. 10. Preferably, after all the elements have been assembled and before the dust cover 626 is secured, the entire assembly including substrate, printed circuits, transistor chips, display package, etc. is coated with a suitable potting compound such as a clear epoxy to protect the entire assembly from the elements.

FIG. 15 is a front plan or top plan view of the main module of watch "movement" forming the principal assembly of the watch generally indicated at 700. FIG. 16 is a cross section through the main assembly 700 taken along line 16—16 of FIG. 15, FIG. 17 is a cross section at right angles to that of FIG. 16 taken along line 17—17 of FIG. 15 and FIG. 18 is a rear or bottom plan view of the main module 700. It comprises a generally circular module frame 702, preferably formed from an impact resistant, one-piece, injection molded plastic material and in the preferred embodiment, is S-2/30 Type 6-10 Nylon which is a fiber filled, electrically insulating nylon material. The frame 702 is of circular or disc shape, one-piece plastic construction and mounted on the front of the frame is the timing module 620. The front surface of the module frame is recessed to receive four reed switches, namely the date demand switch 138, the time demand switch 132, minute set switch 134, and hour set switch 136. A portion of the disc 702 is apertured as at 704 as best seen in cross section in FIG. 17 to receive the piezoelectric crystal 63. The crystal is preferably encased as illustrated in a silicone rubber potting compound 706 which acts as an adhesive to secure the crystal in the module frame, and to support it against excessive vibration. The crystal is provided with a pair of electrical leads 708 and 710 to make electrical connection to the remainder of the circuitry in timing module 620. FIGS. 16 and 18 show the two battery cells 712 and 714. Each of these cells is a conventional one and one-half volt wristwatch battery cell and they are connected in series to provide a three-volt power supply. The batteries are connected in series by a resilient contact 718 secured by electrical insulation to the back plate of the watch and also make contact with positive and negative resilient battery terminals 719 and 721. These are staked to projections 723 and 725 forming part of frame 702 as best seen in FIGS.

15, 15A and 15B. They each have outwardly and upwardly extending contact fingers 727 (FIGS. 15A and 15B) which engage the underside of the respective battery cells 712 and 714. The batteries make electrical connection to the circuit by a lead frame 716 which is secured to the frame 702. Frame 702 has its back surface recessed to receive the trimmer capacitor 65 whose capacitance may be varied by an adjustment screw 720 in FIG. 18. A pair of trimmer leads 722 and 724 pass completely through the frame and are secured to the lead frame 716 as illustrated in FIG. 15. By way of example only, trimmer capacitor 65 may be of the type manufactured by the Johanson Manufacturing Corporation of Boonton, New Jersey. Reed switches 132, 134, 136 and 138 may be of the type more fully shown and described in assignee's U.S. Pat. No. 3,714,867 and are actuated in response to the influence of the magnetic field of a permanent magnet moved into an area adjacent the particular switch to be actuated. Also shown in FIG. 17 is the inertial switch 71 which is connected to the lead frame 716 by a pair of leads 726 and 728. The lead frame is formed as a flat one-piece electrically conductive layer of metal which may be suitably stamped and punched out to the desired configuration. After the enlarged ends or tabs 730 of the lead frame 716 have been attached to the corresponding tabs of the circuit module 620, the outer rim 732 of the lead frame 716 is cut away to provide flat electrical leads of appropriate lengths such as by cutting away the outer rim of the lead frame at approximately the dashed lines 734. After this cutting away, the free ends and intermediate extensions of the lead frame are suitably connected to the circuit elements such as the switches and battery terminals as illustrated in FIG. 15.

FIG. 21 is a view showing the inertial switch 71. As previously indicated, this switch comprises an evacuated glass envelope 582 having a pair of internal contacts (not shown) adjacent its end 736 to which are connected the external electrical leads 726 and 728. If desired, the interior of the glass envelope 71 may be partially or wholly filled with an inert gas to control mechanical viscosity, but in any event, a mercury drop within the envelope is adapted to move longitudinally in the direction of the arrow 738 in FIG. 21 under the influence of inertial forces to alternately make and break the electrical circuit between external leads 726 and 728.

FIG. 22 is a perspective view of a portion of the main module frame 702 showing the manner in which the timing module 620 is mounted on the frame. As illustrated, the frame 702 is preferably molded with a plurality of spaced rectangular projections 740 between which are placed the tabs 742 extending outwardly from the circuit module 620. Portions of the rectangular plastic projections 740 are mashed down at 744 to overlie the edges of the conductive tabs 742 to securely attach timing module 620 to the frame. This is a form of staking in which the plastic projections are deformed by applying to them an ulstrasonic heat staking tool which deforms the plastic of the module frame 702 and causes the timing module 620 to be staked to it. While only a portion of the tabs projecting from the circuit module 620 are shown as staked, it is understood that sufficient ones of two or more sides of the circuit module 620 are similarly secured to the frame to provide rigid support on the frame for the timing module. While a specific staking configuration is shown, it is understood that other configurations with or without notches 746 in the tabs may be utilized as well as projections extending upwardly through appropriate holes in the tabs 742, in all instances the tabs being joined to the frame by deforming with heat suitable projections extending upwardly from plastic frame 702.

FIG. 23 is a perspective view showing one manner of securing the four reed switches (and the inertial switch 71) to the module frame 702. In this embodiment, the surface of the module frame is provided with a suitable well 750 adapted to receive one of the switches and extending upwardly from the well to partially overlie the switch are a pair of L-shaped projections 752 and 754. The material of the plastic frame 702 possesses sufficient resiliency so that the switch may be inserted into the space beyond the ends 756 of the projections and resiliently snapped into position such that the upper laterally extending arms 758 overlie the switch as illustrated in FIG. 15 to tightly and resiliently retain the switch between arms 758 of the projections and the bottom of well 750.

FIG. 24 is a perspective view of a modified arrangement for securing the switches to the plastic frame 702. In this embodiment, the frame is again provided with a well 760 in which is molded a bifurcated or slotted boss or projection 762. FIG. 25 is a longitudinal cross section through the bass 762 and FIG. 26 is a cross section through the boss taken at right angles to that of FIG. 25. The two halves 764 and 766 are internally curved as illustrated in FIG. 26 to define the spaced projecting lips 768 and 770. Again, the resilient nature of the plastic material of frame 702 is relied upon to secure the switch to the frame. That is, the switch is forced between the lips 768 and 770, causing the lips to spread apart and then snap back to overlie the switch as illustrated, for example, at switch 134 in FIG. 15, so that the switch is securely and resiliently held to the frame between the lips and the bottom of the well 760.

In the preferred embodiment, the light emitting diodes take the form more fully shown and described in assignee's U.S. Pat. No. 3,576,099. However, it is understood that other types of light emitting diodes may be used and the display can assume any one of several forms. For example, the optical display may be formed of such well known devices as miniature incandescent bulbs, the well known liquid crystals, or lesser known devices such as ferroelectric crystals or electroluminescent displays and others. The two demand and the setting switches are all formed as magnetic reed switches shown and described in assignee's U.S. Pat. No. 3,714,867. Preferably time demand switch 132 and date demand switch 138 are actuated by permanent magnets carried in their respective pushbuttons 18 and 20. Hour set switch 136 and minute set switch 138 are operated by separate permanent magnet manually applied to the exterior of the watch case adjacent the respective switches in the manner described.

The wristwatch of this invention is of simplified, inexpensive construction and one that is easy to assemble and reliable in operation. The entire timing or circuit module 620 is preferably completely enclosed in a potting compound such as by being coated with a transparent lacquer or epoxy to render the unitary module completely enclosed and substantially impervious to the elements. The watch provides a rugged impact resistant one piece injection molded module frame which houses the entire module assembly including the battery cells. The construction provides durable lead frame connections between the cells and the module and the trimmer capacitor is easily accessible to adjust the crystal oscillator frequency by removal of the back case of the watch. This same accessibility is available for replacement of the batteries.

Important features of the present invention include the compactness, particularly of the electronic module 620 but also of the main module 70 including the completely assembled support frame and batteries. By way of example only, the overall diameter of the main module 700 in FIG. 15 in one embodiment of the present invention is 1.186 inches whereas the overall thickness of this module from the front of the LED display to the rear edge of the batteries as shown in FIG. 17 is 0.346 inch. Because of this relatively thin and small diameter construction, it is possible to incorporate the main module of the present invention into a watch case to form a relatively small sized man's wristwatch.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A solid state wristwatch comprising a watch case, an electrically insulating frame mounted in said case, and a timing module mounted on said frame, said timing module comprising a multi-layer electrically insulating substrate, an electrically conductive circuit on opposite outer surfaces and at least one intermediate surface of said substrate, conductive means passing through said substrate and electrically interconnecting said circuits, a plurality of electro-optical digital display stations on one said outer surface of said substrate, and a large scale integrated timing circuit chip on the other of said outer surfaces of said substrate.

2. A wristwatch according to claim 1 wherein said substrate comprises a plurality of layers of ceramic material.

3. A wristwatch according to claim 2 wherein said substrate comprises two ceramic layers.

4. A wristwatch according to claim 1 wherein said timing circuit chip is wire bonded to the circuit on said other outer surface of said substrate.

5. A wristwatch according to claim 1 wherein said large scale integrated circuit chip comprises both a timekeeping circuit and a calendar circuit.

6. A wristwatch according to claim 1 wherein said timing module is staked to said frame.

7. A wristwatch according to claim 1 wherein said frame is provided with at least one cavity for receiving a battery, and an electrical lead frame coupling said cavity to said timing module.

8. A wristwatch according to claim 1 wherein said display stations each comprise a plurality of light emitting diodes.

9. A wristwatch according to claim 1 wherein said frame comprises at least one well and cooperating resilient projection, and a switch resiliently retained in said well by said projection.

10. A wristwatch according to claim 9 wherein said frame is made of electrically insulating plastic.

11. A wristwatch according to claim 9 wherein said switch comprises a reed switch.

12. A wristwatch according to claim 1 including an inertial switch mounted on said frame, and means coupling said inertial switch to said integrated circuit chip.

13. A wristwatch according to claim 12 wherein said integrated circuit chip includes a delay circuit for said inertial switch.

14. A wristwatch according to claim 13 wherein said chip is made of complementary symmetry MOS transistors.

15. A solid state wristwatch module for insertion into a watch case comprising an electrically insulating plastic frame, a plurality of switches on said frame, a piezoelectric crystal and a trimmer capacitor mounted on said frame, a timing module mounted on said frame, means on said frame electrically coupling said switches, said piezoelectric crystal and said trimmer capacitor to said timing module, said timing module comprising a multi-layer ceramic substrate, a printed circuit on opposite outer surfaces and at least one intermediate surface of said substrate, a plurality of conductive pins passing through said substrate and electrically interconnecting said printed circuits, a plurality of digital light emitting diode display stations mounted on one said outer surface of said substrate and electrically connected to the printed circuit on that surface, and a large scale integrated circuit chip including both a timekeeping circuit and a calendar circuit mounted on the other of said outer surfaces and electrically connected to the printed circuit on said other outer surface.

16. A wristwatch module according to claim 15 wherein said timing module is coated with a clear potting compound.

17. A wristwatch module according to claim 15 including a dust cover overlying said integrated circuit chip and secured to said substrate.

18. A wristwatch module according to claim 15 including a photosensor on said one outer surface of said substrate adjacent said display stations, and means coupling said photosensor to said integrated circuit chip.

19. A wristwatch according to claim 15 including a segment driver transistor array on said other surface of said substrate, and means coupling said arrays to said integrated circuit chip and to said display stations.

* * * * *